US012275614B2

(12) United States Patent
Noda

(10) Patent No.: US 12,275,614 B2
(45) Date of Patent: Apr. 15, 2025

(54) SHEET CONVEYANCE APPARATUS, SHEET PROCESSING APPARATUS, AND IMAGE FORMING APPARATUS

(71) Applicant: CANON KABUSHIKI KAISHA, Tokyo (JP)

(72) Inventor: Shinya Noda, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 247 days.

(21) Appl. No.: 17/977,140

(22) Filed: Oct. 31, 2022

(65) Prior Publication Data

US 2023/0142336 A1 May 11, 2023

(30) Foreign Application Priority Data

Nov. 11, 2021 (JP) ..... 2021-183831

(51) Int. Cl.
*F16M 11/00* (2006.01)
*B65H 7/14* (2006.01)
*B65H 31/10* (2006.01)

(52) U.S. Cl.
CPC ..... *B65H 7/14* (2013.01); *B65H 31/10* (2013.01); *B65H 2553/41* (2013.01); *B65H 2801/06* (2013.01)

(58) Field of Classification Search
CPC ..... B65H 7/14; B65H 31/10; B65H 2553/41; B65H 2801/06; B65H 43/08; B65H 2405/11151; B65H 2405/332; B65H 2511/515; B65H 2402/44; B65H 2405/113; B65H 2511/51; B65H 2553/61; G03G 21/1652; G03G 15/80
See application file for complete search history.

(56) References Cited

U.S. PATENT DOCUMENTS 6,607,169 B1 * 8/2003 Gershfeld ..... A47B 21/06 248/65
7,098,406 B1 * 8/2006 Hammonds ..... B65H 75/06 242/388
10,311,999 B2 * 6/2019 Sung ..... H02G 11/00
10,604,376 B2 * 3/2020 Park ..... B65H 75/20
2010/0032531 A1 * 2/2010 Getts ..... F16L 3/01 248/58
2012/0000688 A1 * 1/2012 Busse ..... H04Q 1/06 248/65
2019/0071279 A1 * 3/2019 Park ..... B65H 75/366
2020/0373688 A1 * 11/2020 Moshggoo ..... H02G 15/1806

FOREIGN PATENT DOCUMENTS

JP 2007304199 A 11/2007
JP 2009116114 A 5/2009
JP 2010165605 A 7/2010
JP 2019075929 A 5/2019

* cited by examiner

*Primary Examiner* — Amy J. Sterling

(74) *Attorney, Agent, or Firm* — ROSSI, KIMMS & McDOWELL LLP

(57) ABSTRACT

A sheet conveyance apparatus includes a casing, an electric cable including a conductor and an insulator configured to cover the conductor, and a guide member attached to the casing and configured to guide the electric cable, wherein the guide member includes a wire-forming member formed of a metal wire, and wherein the electric cable is wired along the guide member with at least one of the electric cable and the guide member twisted around the other of the electric cable and the guide member.

22 Claims, 13 Drawing Sheets

SHEET CONVEYANCE APPARATUS, SHEET PROCESSING APPARATUS, AND IMAGE FORMING APPARATUS

BACKGROUND OF THE INVENTION

Field of the Invention

The present invention relates to a sheet conveyance apparatus for conveying sheets, a sheet processing apparatus for processing the sheets, and an image forming apparatus for forming images on sheets.

Description of the Related Art

Image forming apparatuses such as printers, copying machines and multifunction devices, and attachments thereof are equipped with a sheet conveyance apparatus for conveying sheets. The sheet conveyance apparatus is equipped with an actuator such as a motor or a sensor such as a sheet detection sensor, a control board for controlling the same or a power supply board terminal for supplying power thereto, and an electric cable connecting these components electrically. One example of a wiring method of such electric cables is a method in which guide members formed of resin that are molded into shapes along the wiring path are attached to a casing, and electric cables are supported by hooks provided on the guide members. Further, Japanese Patent Application Laid-Open Publication No. 2009-116114 discloses a cable wiring configuration for transmitting information from a scanner to a printer, wherein the cables are wired by having the cables nipped between projection pairs provided on a rear cover of the printer, or wired by having the cables hooked on L-shaped projections.

However, when guide members formed of resin is used, both the size of the guide members themselves and the space around the guide members are required to be large enough to ensure strength of the guide members and the workability for wiring the cables along the guide members, which leads to increase in size of the apparatus. Meanwhile, the wiring configuration according to the above-mentioned document has drawbacks in that the nipping and hooking of electric cables on each of the number of projections provided on the casing was troublesome, and there were demands to improve the workability of the wiring operation.

SUMMARY OF THE INVENTION

The present invention provides a sheet conveyance apparatus in which workability of a wiring operation can be improved while reducing a space required for wiring.

According to one aspect of the invention, a sheet conveyance apparatus includes a casing, an electric cable including a conductor and an insulator configured to cover the conductor, and a guide member attached to the casing and configured to guide the electric cable, wherein the guide member includes a wire-forming member formed of a metal wire, and wherein the electric cable is wired along the guide member with at least one of the electric cable and the guide member twisted around the other of the electric cable and the guide member.

Further features of the present invention will become apparent from the following description of exemplary embodiments with reference to the attached drawings.

DESCRIPTION OF THE EMBODIMENTS

Embodiments according to the present disclosure will be described with reference to the drawings.

First Embodiment

Figure 1:
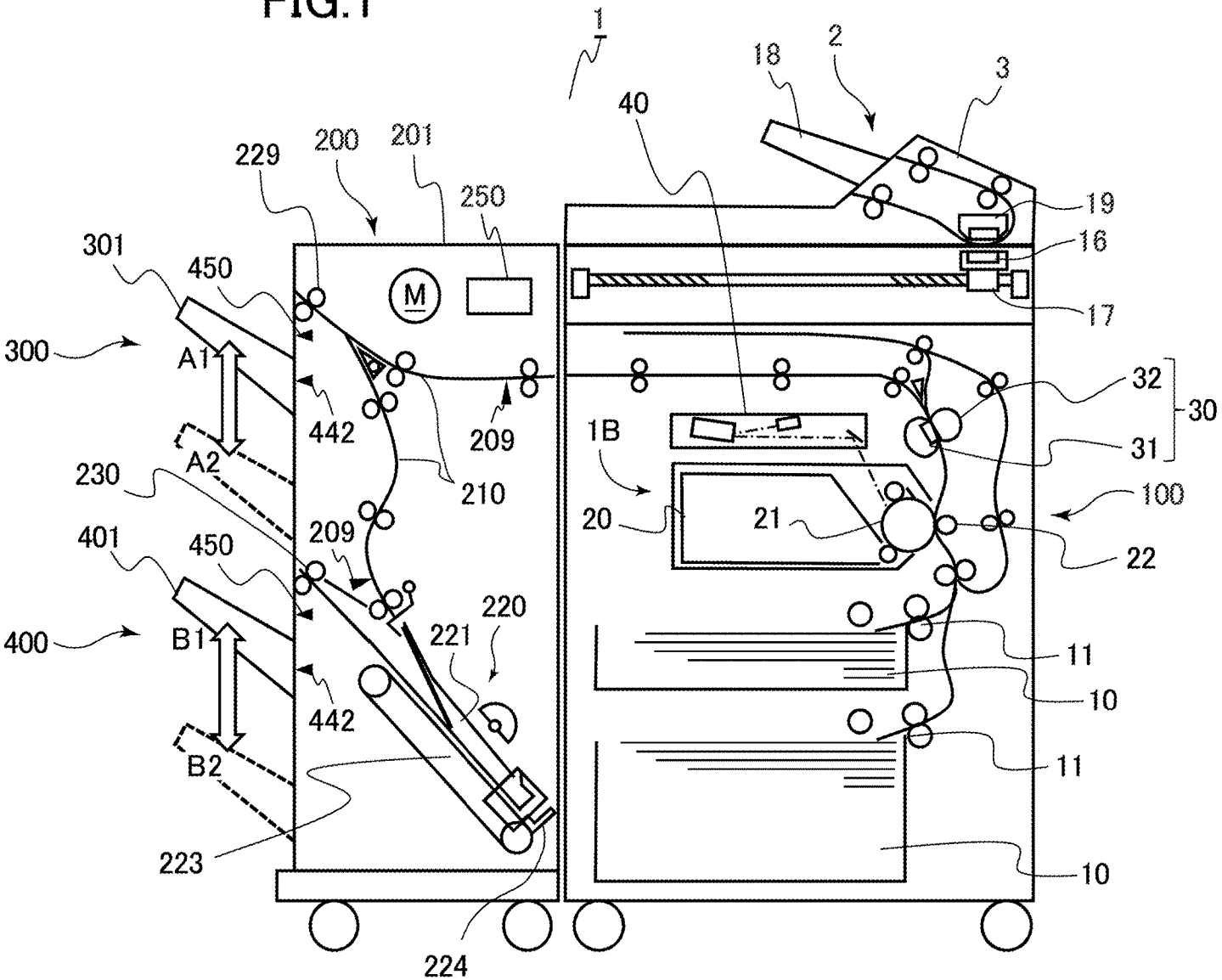
FIG. 1 is a schematic view of an image forming apparatus according to a first embodiment.

At first, an outline of an image forming system, or apparatus, according to a first embodiment will be described. FIG. 1 is a schematic view of an image forming system 1 according to the present embodiment. The image forming system 1 is composed of an image forming apparatus body 100, an image forming apparatus 2, a document feeder 3, and a postprocessing apparatus 200. The image forming system 1 forms an image on a sheet serving as a recording material, and if necessary, subjects the sheet to processing in the postprocessing apparatus 200 before outputting the sheet. Operations of respective apparatuses are described briefly, and thereafter, the postprocessing apparatus 200 will be described in detail.

The document feeder 3 conveys the document placed on a document tray 18 to image reading units 16 and 19. The image reading units 16 and 19 are each an image sensor that reads image information from document surfaces, and images are read from both sides of a document in a single document conveyance. The document having the image information read therefrom is discharged onto a document discharge unit. Further, the image forming apparatus 2 reads the image information from a static document, including a document such as a booklet document which cannot be conveyed through the document feeder 3, set on a platen glass by moving an image reading unit 16 in reciprocating movement by a driving device 17.

The image forming apparatus body 100 is an electrophotographic device equipped with a direct-transfer-type image forming unit 1B. The image forming unit 1B includes a cartridge 20 equipped with a photosensitive drum 21, and a laser scanner unit 40 arranged above the cartridge 20. When performing an image forming operation, a surface of the photosensitive drum 21 being rotated is charged, and by exposing the surface of the photosensitive drum 21 by the laser scanner unit 40 based on image information, an electrostatic latent image is formed on the drum surface. The electrostatic latent image borne on the photosensitive drum 21 is developed into a toner image by charged toner, i.e., developer, and the toner image is conveyed to a transfer portion where the photosensitive drum 21 and a transfer roller 22 oppose one another. A controller of the image forming apparatus body 100 executes an image forming operation by the image forming unit 1B based on image information read by the image reading units 16 and 19 or image information received from an external computer via a network.

The image forming apparatus body 100 includes a storage 10 for storing sheets serving as recording material, and a sheet feeding apparatus 11 for feeding sheets one at a time from the storage 10. The sheet fed from the sheet feeding apparatus 11 is subjected to skew correction at a registration roller, conveyed to a transfer portion, and at the transfer portion, has the toner image borne on the photosensitive drum 21 transferred thereto. A fixing unit 30 is arranged downstream of the transfer portion in a sheet conveyance direction. The fixing unit 30 includes a rotary member pair that nips and conveys the sheet and a heating element such as a halogen lamp for heating the toner image, and performs an image fixing process by heating and pressing the toner image on the sheet.

The sheet having passed through the fixing unit 30 is conveyed to the postprocessing apparatus 200. In the case of a sheet to which image formation on a first side has been completed in duplex printing, the sheet having passed through the fixing unit 30 is reversed in the image forming apparatus body 100 and reconveyed to a registration roller 7. Then, the sheet is passed through the transfer portion and the fixing unit 30 again to have an image formed on a second side thereof before being conveyed to the postprocessing apparatus 200.

The image forming unit 1B described above is merely an example of an image forming unit for forming images on sheets, and it is also possible to use an intermediate transfer-type electrophotographic unit for transferring the toner image formed on a photosensitive member via an intermediate transfer body to the sheet. Furthermore, an inkjet-type or offset printing-type printing unit can also be used as the image forming unit.

Postprocessing Apparatus

The postprocessing apparatus 200 is a sheet processing apparatus for processing a sheet on which an image has been formed by the image forming apparatus body 100. The postprocessing apparatus 200 is an example of a sheet conveyance apparatus in which sheets are conveyed. The postprocessing apparatus 200 according to the present embodiment includes a binding unit 220 serving as a processing unit for binding sheets, wherein the sheets received from the image forming apparatus body 100 are subjected to a binding process before being discharged as a sheet bundle. Further, the postprocessing apparatus 200 can simply discharge the sheets received from the image forming apparatus body 100 without performing a binding process thereto.

The postprocessing apparatus 200 includes a sheet conveyance path 210, a plurality of conveyance roller pairs arranged along the sheet conveyance path 210 and serving as conveyance members for conveying sheets, a sensor for detecting sheets passing through the sheet conveyance path 210, an upper sheet discharge tray 301, and a lower sheet discharge tray 401. The sheet conveyance path 210 is branched inside a casing 201 of the postprocessing apparatus 200, and includes a sheet discharge path leading to the upper sheet discharge tray 301 and a sheet discharge path leading to the lower sheet discharge tray 401. The plurality of conveyance roller pairs includes an upper sheet discharge roller 229 for discharging sheets to the upper sheet discharge tray 301 and a lower sheet discharge roller 230 for discharging sheets to the lower sheet discharge tray 401.

The binding unit 220 is provided on a conveyance path leading to the lower sheet discharge tray 401. In the present embodiment, the sheet heading toward the lower sheet discharge tray 401 is reversed and conveyed by the upper sheet discharge roller 229 toward the binding unit 220, passed through the binding unit 220, and discharged onto the lower sheet discharge tray 401.

The binding unit 220 includes an intermediate stacking portion 221 on which a plurality of sheets received from the image forming apparatus body 100 are stacked, and a stapler 222 for stapling the sheets stacked and aligned on the intermediate stacking portion 221. A sheet bundle bound by the stapler 222 is pushed out from the intermediate stacking portion 221 by a push-out guide 224 driven by a guide driving unit 223 and transferred to the lower sheet discharge roller 230. In a case where the sheet is discharged onto the lower sheet discharge tray 401 without performing a binding process, the sheet discharged onto the intermediate stacking portion 221 is transferred as it is by the push-out guide 224 to the lower sheet discharge roller 230.

The postprocessing apparatus 200 includes a plurality of motors M for driving the plurality of conveyance roller pairs and the lifting and lowering of the upper sheet discharge tray 301 and the lower sheet discharge tray 401, at least one sheet sensor 209 arranged along the sheet conveyance path 210, and a sheet presence sensor 442 and a sheet leaning sensor 450 described later. A photoelectric sensor, such as a photo-interrupter or a photo-reflector, can be used as the sheet sensor 209 for generating detection signals corresponding to a presence or absence of a sheet detected using light.

These actuators and sensors operate based on command signals from a control unit 250 installed in the postprocessing apparatus 200, or enter detection signals to the control unit 250. Therefore, the postprocessing apparatus 200 is equipped with electric cables for electrically connecting the control unit 250 and the actuators or sensors, including a cable harness W described later. The postprocessing apparatus 200 is also equipped with electric cables for connecting a power supply board for supplying power to the actuators and sensors with the actuators or the sensors, and electric cables for connecting the control unit 250 of the postprocessing apparatus 200 with the control unit of the image forming apparatus body 100 in a communicable manner.

The control unit 250 includes at least one processor, and a storage device for storing control programs. The processor reads and executes a control program from the storage device to control the postprocessing apparatus 200. The control unit 250 according to the present embodiment is connected to the control unit of the image forming apparatus body 100 in a manner capable of communicating mutually therewith, and controls the operation of the actuators based on the information notified from the control unit of the image forming apparatus body 100 and detection signals from sensors.

The postprocessing apparatus 200 includes an upper sheet discharge unit 300 and a lower sheet discharge unit 400 as sheet discharge destinations. The upper sheet discharge unit 300 is equipped with the upper sheet discharge tray 301 and the lower sheet discharge unit 400 is equipped with the lower sheet discharge tray 401. The upper sheet discharge tray 301 and the lower sheet discharge tray 401 are both capable of moving up and down, that is, being lifted and lowered, with respect to the casing 201 of the postprocessing apparatus 200.

The control unit 250 is equipped with sheet surface detection sensors for detecting upper surface positions of the sheets, that is, stacking height of the sheets, on the upper sheet discharge tray 301 and the sheets on the lower sheet discharge tray 401, and if one of the sensors detects sheets, the corresponding tray is lowered in the direction of A2 or B2. Further, if removal of sheets on the upper sheet discharge tray 301 or the lower sheet discharge tray 401 is detected by the sheet surface detection sensor, the corresponding tray is lifted in the direction of A1 or B1. Thus, the upper sheet discharge tray 301 and the lower sheet discharge tray 401 are controlled to be lifted and lowered according to the stacked amount of the sheets such that the upper surface of the stacked sheets is maintained at a constant height. According to the present embodiment, the upper sheet discharge tray 301 serving as a first stacking portion and the lower sheet discharge tray 401 serving as a second stacking portion are respectively controlled to be lifted and lowered by a motor, but it is also possible to adopt a configuration where they are lifted and lowered by urging members such as springs.

In the following description and drawings, a Z axis direction refers to a vertical direction, or the gravity direction, in a state where the postprocessing apparatus 200 is installed on a horizontal plane. An X axis direction refers to a direction orthogonal to the Z axis direction and which is a direction along a side face of the postprocessing apparatus 200 on which the upper sheet discharge tray 301 and the lower sheet discharge tray 401 are provided. A Y axis direction refers to a direction orthogonal to both the Z axis direction and the X axis direction. The X axis direction can be described as a sheet width direction of the sheet discharged onto the upper sheet discharge tray 301 or the lower sheet discharge tray 401. Further, shapes and positional relationships of members that are detachably attached to the casing 201 with respect to the postprocessing apparatus 200 is described based on the state in which they are attached to the casing 201.

Lower Sheet Discharge Unit

The upper sheet discharge unit 300 and the lower sheet discharge unit 400 adopt an approximately equivalent configuration. Only the lower sheet discharge unit 400 will be described below, but the upper sheet discharge unit 300 has a similar configuration.

Figure 2:
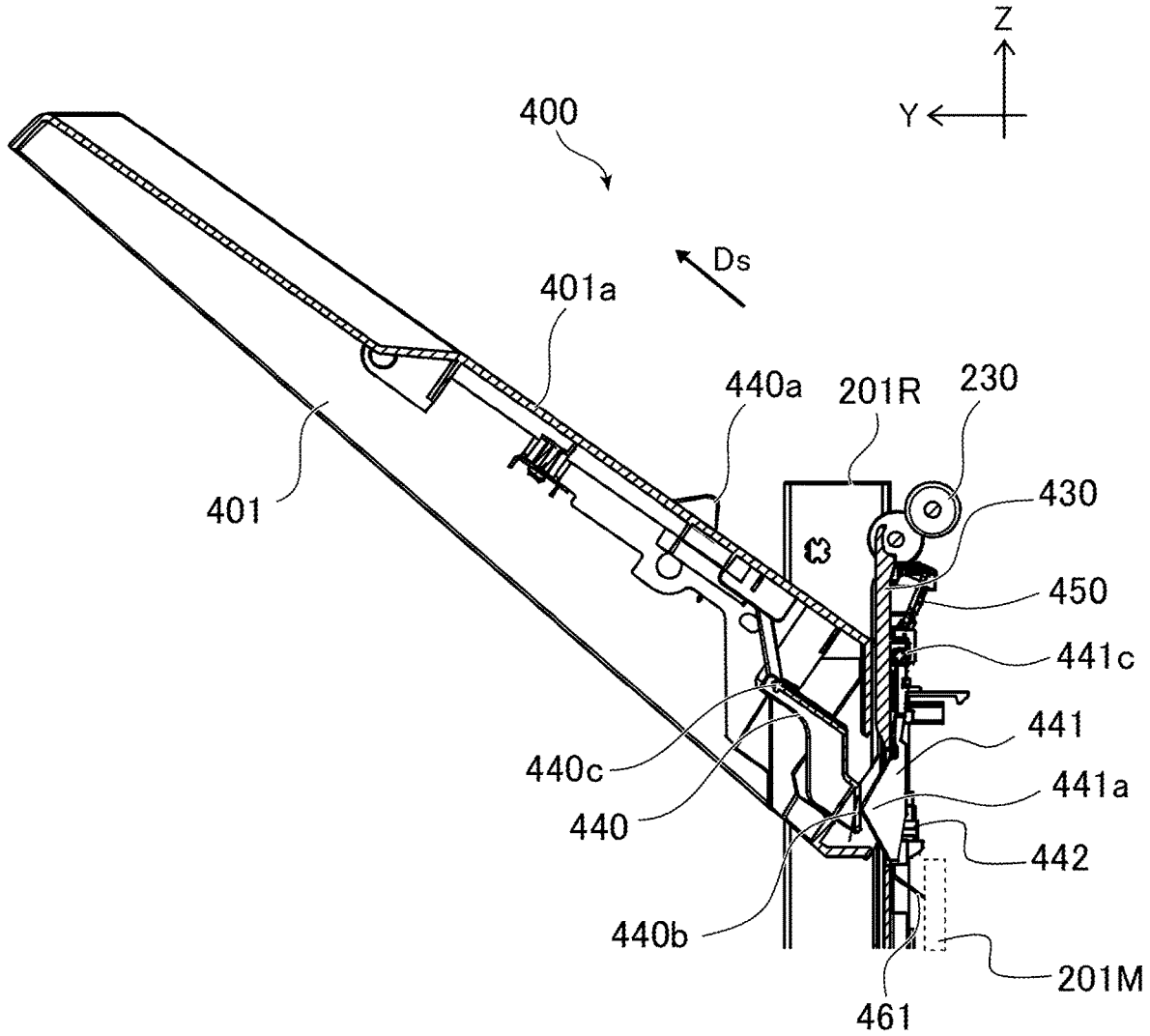
FIG. 2 is a cross-sectional view of a lower sheet discharge unit according to the first embodiment.
Figure 3:
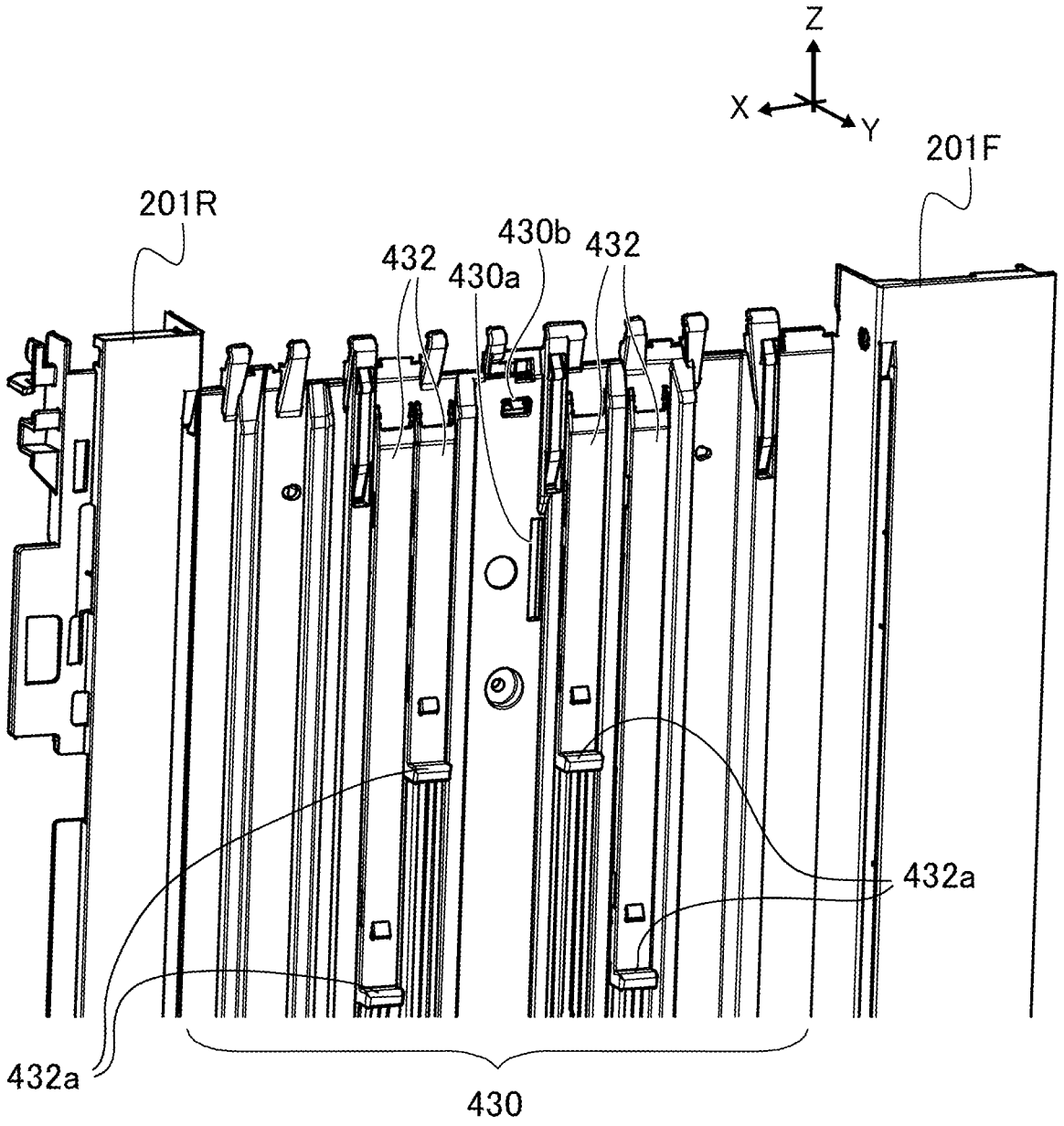
FIG. 3 is a perspective view of a support wall according to the first embodiment.
Figure 4:
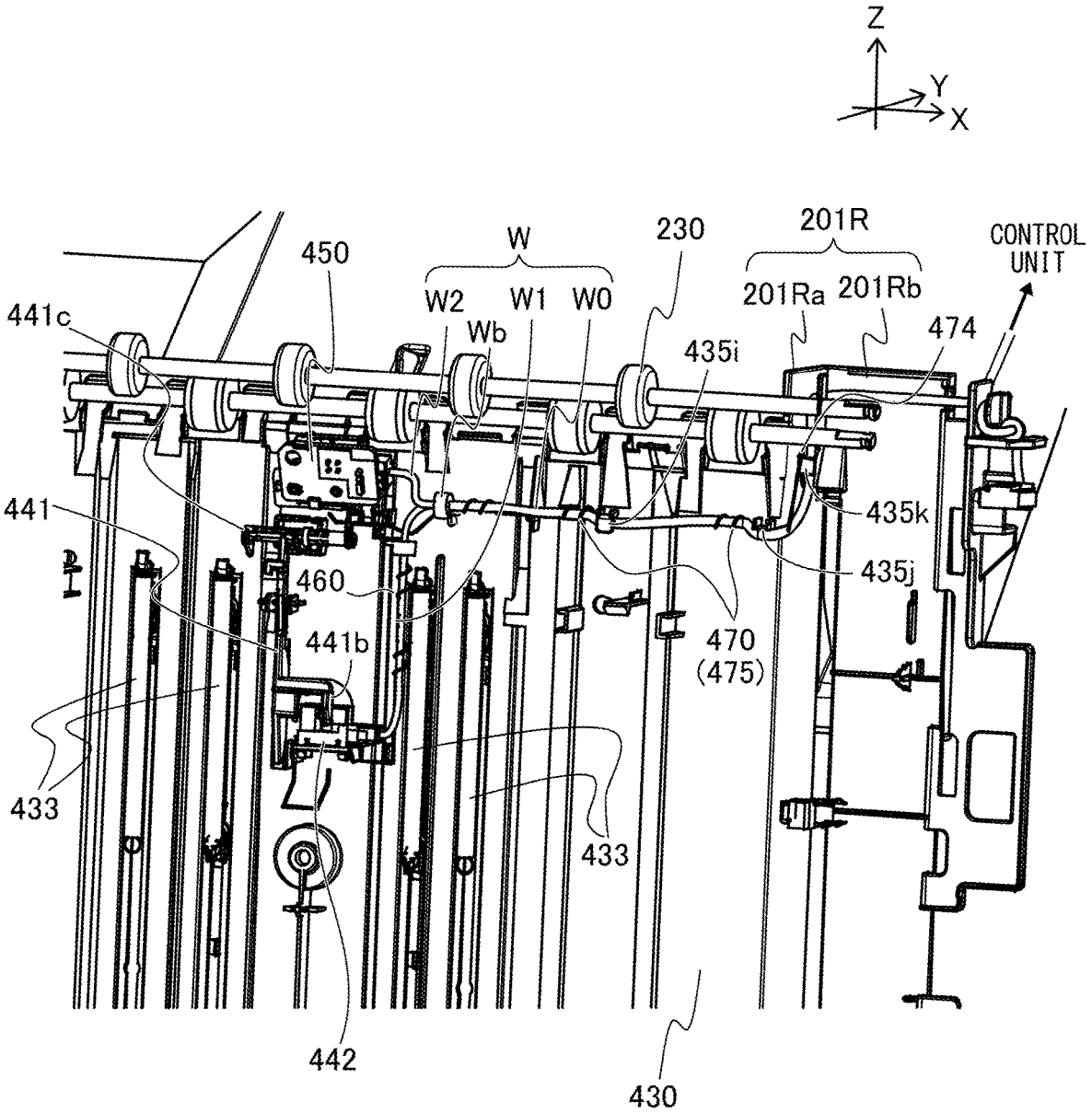
FIG. 4 is a perspective view illustrating a wiring configuration according to the first embodiment.

FIG. 2 is a cross-sectional view of the postprocessing apparatus 200 illustrating the lower sheet discharge unit 400, showing a state in which the postprocessing apparatus 200 is cut at a plane perpendicular to the X axis direction. FIG. 3 is a perspective view illustrating a side face of the postprocessing apparatus 200 with the lower sheet discharge tray 401 removed. FIG. 4 is a perspective view illustrating a side face of the postprocessing apparatus 200 shown in FIG. 3 from an inner side of the casing 201.

As illustrated in FIG. 2, the lower sheet discharge unit 400 includes the lower sheet discharge roller 230, a support wall 430, the lower sheet discharge tray 401, a sheet presence lever 440, a sheet presence flag 441, the sheet presence sensor 442, and a sheet leaning sensor 450.

The lower sheet discharge roller 230 conveys sheets, or sheet bundles, conveyed within the postprocessing apparatus 200 to a sheet discharge direction Ds that is inclined upward toward the Y axis direction and discharges the sheets to the exterior of the casing 201 of the postprocessing apparatus 200. The lower sheet discharge roller 230 is a pair of rollers, each roller rotating about a roller shaft that extends in the X axis direction. Further, the lower sheet discharge roller 230 is designed such that an upper side roller is moved toward and away from a lower side roller in the drawing to open and close the nip portion, thereby enabling a sheet bundle having been subjected to a binding process in the binding unit 220 to be discharged.

The lower sheet discharge tray 401 is protruded from the casing 201 of the postprocessing apparatus 200 in the Y axis direction. The lower sheet discharge tray 401 is a stacking portion on which sheets discharged from the inside of the casing 201 to the exterior are stacked. The lower sheet discharge tray 401 includes a stacking surface 401*a* serving as a sheet support surface on which sheets, or sheet bundles, discharged from the lower sheet discharge roller 230 are stacked. The stacking surface 401*a* is inclined upward toward a direction separating from the casing 201 in the Y axis direction.

The lower sheet discharge tray 401 is configured to be lifted and lowered with respect to the casing 201 by the driving force of the motor arranged in the casing 201. As an actual configuration example, a belt stretched in the up-down direction in the casing 201, wherein a frame supporting the lower sheet discharge tray 401 is connected to the belt and a belt pulley is driven by the driving force of the motor.

The support wall 430 is a wall member constituting at least a part of a side face, i.e., wall surface, of the casing 201 in the Y axis direction, which is extended in the Y axis direction and the Z axis direction. The casing 201 is an approximately rectangular parallelepiped structure, i.e., casing or apparatus body, including a frame body and an exterior member of the postprocessing apparatus 200.

As illustrated in FIG. 3, the support wall 430 is disposed between a front frame 201F and a rear frame 201R constituting a frame body of the casing 201. The front frame 201F and the rear frame 201R are positioned at the corner portion of the casing 201 when viewed from above, and they are both a pillar member extending in the Z axis direction. The front frame 201F is positioned at the front side of the image forming system 1 in the X axis direction, and the rear frame 201R is positioned at the rear side of the image forming system 1 in the X axis direction.

As illustrated in FIG. 3, sliding walls 432 serving as sliding members that can be lifted and lowered together with the lower sheet discharge tray 401 are provided on the support wall 430. The sliding walls 432 have an abutting surface against which trailing edges, i.e., upstream edges in the sheet discharge direction Ds, of sheets stacked on the lower sheet discharge tray 401 are abutted. By having the sliding walls 432 against which the trailing edges of sheets are abutted move up and down with the lower sheet discharge tray 401, the possibility of trailing edges of sheets being rubbed against the support wall 430 and damaged during lifting and lowering of the lower sheet discharge tray 401 can be reduced.

As illustrated in FIGS. 3 and 4, the sliding walls 432 are attached slidably approximately in the Z axis direction with respect to the support wall 430, and each sliding wall 432 is urged upward by a tension spring 433. The tension springs 433 are each a coil spring that has its axial direction arranged along the up-down direction, i.e., Z axis direction. When the lower sheet discharge tray 401 is lowered, the sliding walls 432 are moved downward following the lowering of the lower sheet discharge tray 401 by having tray abutment portions 432*a* pressed by the lower sheet discharge tray 401. When the lower sheet discharge tray 401 is lifted, the sliding walls 432 are moved upward following the lifting of the lower sheet discharge tray 401 by urging force of the tension springs 433.

Heights of the tray abutment portions 432*a* define a position at which the sliding walls 432 start to move following the movement of the lower sheet discharge tray 401. In the present embodiment, among the four sliding walls 432, one set of sliding walls arranged on the inner side in the X axis direction, i.e., sheet width direction, has a height of the tray abutment portions 432*a* that differs from the height of the tray abutment portions 432*a* of one set of sliding walls arranged on the outer side thereof. Therefore, in a state where the lower sheet discharge tray 401 is lowered for a predetermined distance from an initial position, one pair of sliding walls 432 arranged on the inner side start to move following the movement of the lower sheet discharge tray 401. Thereafter, if the lower sheet discharge tray 401 is lowered further, the pair of sliding walls 432 arranged on the outer side also start to move following the movement of the lower sheet discharge tray 401. According to such configuration, even if a large number of sheets is stacked, the possibility of trailing edges of sheets being rubbed against the support wall 430 and damaged during lifting and lowering of the lower sheet discharge tray 401 can be reduced.

The sheet presence lever 440, the sheet presence flag 441, the sheet presence sensor 442, and the sheet leaning sensor 450 are provided to detect the state of sheets in the lower sheet discharge unit 400. The sheet presence sensor 442 is a first sensor according to the present embodiment, and the sheet leaning sensor 450 is a second sensor according to the present embodiment.

Sheet Presence Detection

At first, the sheet presence lever 440, the sheet presence flag 441, and the sheet presence sensor 442 that serve as a detection mechanism for detecting presence and absence of sheets on the lower sheet discharge tray 401 are described.

As illustrated in FIGS. 2 and 4, the sheet presence lever 440 includes a sheet abutment portion 440*a*, a flag abutment portion 440*b*, and a swing shaft 440*c*. The sheet presence lever 440 is supported via the swing shaft 440*c* on the lower sheet discharge tray 401, and is capable of swinging about the swing shaft 440*c*. The sheet presence lever 440 is a moving member, i.e., swinging member or first moving member, arranged on the lower sheet discharge tray 401 and moved when pressed by sheets on the lower sheet discharge tray 401.

The sheet abutment portion 440*a* is movable by swinging of the sheet presence lever 440 between a protruding position, i.e., upper position, protruding upward of the stacking surface 401*a* of the lower sheet discharge tray 401 and a retracting position, i.e., lower position, where it is retrieved to a same height as the stacking surface 401*a*. The flag abutment portion 440*b* pushes the sheet presence flag 441 when the sheet abutment portion 440*a* moves from the protruding position to the retracting position.

As illustrated in FIGS. 2 and 4, the sheet presence flag 441 includes a lever abutment portion 441*a*, a sensor shielding portion 441*b*, and a swing shaft 441*c*. The sheet presence flag 441 is supported via the swing shaft 441*c* on the support wall 430, and is capable of swinging about the swing shaft 441*c*. The sheet presence flag 441 is a second moving member provided on the casing 201 and moved in linkage with the sheet presence lever 440, i.e., first moving member. The sheet presence flag 441 is an example of a movable member that moves by being in contact with an object on an outside of the casing 201, which, in this case, is the sheet presence lever 440. The target object can also be an object other than sheets.

The lever abutment portion 441*a* is a portion that abuts against the flag abutment portion 440*b* of the sheet presence lever 440. The lever abutment portion 441*a* is movable between a standby position that is protruded outside the casing 201 in the Y axis direction through a slit 430*a* (FIG. 3) by the swinging of the sheet presence flag 441 and an operation position having moved toward an inner side of the casing 201 from the standby position. The slit 430*a* is an opening portion provided on the support wall 430. FIG. 2 illustrates a state in which the sheet presence flag 441 is at the standby position. The sensor shielding portion 441*b* is a member being detected by the sheet presence sensor 442 serving as a detecting portion.

The sheet presence sensor 442 is a sensor that is attached to the support wall 430 for detecting the swinging of the sheet presence flag 441. The sheet presence sensor 442 is configured to output a detection signal according to the presence or absence of sheets on the lower sheet discharge tray 401.

In the present embodiment, a photo-interrupter, i.e., transmissive photosensor, is used as the sheet presence sensor 442, which is shielded of light by the sensor shielding portion 441*b* of the sheet presence flag 441. Specifically, the sheet presence sensor 442 includes a light emitting portion, i.e., light emitting element such as an LED, and a light receiving portion, i.e., light receiving element such as a photodiode, that oppose one another. The signal, i.e., voltage value, generated by the light receiving portion varies according to the amount of light received by the light receiving portion.

When the lever abutment portion 441*a* is not pressed by the sheet presence lever 440, the sheet presence flag 441 is arranged such that the sensor shielding portion 441*b* blocks an optical path from the light emitting portion to the light receiving portion. Further, when the lever abutment portion 441*a* is pressed by the sheet presence lever 440, the sheet presence flag 441 is arranged such that the sensor shielding portion 441*b* is retrieved from the optical path from the light emitting portion to the light receiving portion. Further, when the lower sheet discharge tray 401 is positioned at an initial position, or home position, illustrated in FIG. 2, the flag abutment portion 440*b* of the sheet presence lever 440 is opposed to the lever abutment portion 441*a* of the sheet presence flag 441.

According to such configuration, with the lower sheet discharge tray 401 positioned at the initial position as illustrated in FIG. 2, the sheet presence sensor 442 outputs a signal corresponding to the presence or absence of sheets on the lower sheet discharge tray 401. That is, if no sheet is stacked on the lower sheet discharge tray 401, the sheet abutment portion 440*a* of the sheet presence lever 440 is positioned at the protruding position and the sensor shielding portion 441*b* of the sheet presence flag 441 shields the sheet presence sensor 442. In this case, the light receiving portion of the sheet presence sensor 442 outputs a signal corresponding to the shielded state. Meanwhile, if a sheet is stacked on the lower sheet discharge tray 401, the sheet abutment portion 440*a* of the sheet presence lever 440 is pressed by the sheet and moves to the retracting position, and the sensor shielding portion 441*b* of the sheet presence flag 441 moves to a position so as not to shield the sheet presence sensor 442. In this case, the light receiving portion of the sheet presence sensor 442 outputs a signal corresponding to the transmitted state. The control unit 250 (FIG. 1) of the postprocessing apparatus 200 can determine the presence or absence of sheets stacked on the lower sheet discharge tray 401 based on the detection signal of the sheet presence sensor 442.

Sheet Leaning Detection

Next, the sheet leaning sensor 450 serving as a detection mechanism for detecting that leaning of sheets has occurred in the lower sheet discharge unit 400 will be described.

As illustrated in FIGS. 2 and 4, the sheet leaning sensor 450 is attached to the support wall 430. The sheet leaning sensor 450 is configured to output a detection signal corresponding to whether a trailing edge portion of the sheet discharged onto the lower sheet discharge tray 401 is leaning against the support wall 430.

In the present embodiment, a photo reflector, i.e., reflective photosensor, that includes a light emitting portion, i.e., light emitting element such as an LED, that emits light to the outer side of the support wall 430 and a light receiving portion or detecting portion, i.e., light receiving element such as a photodiode, that detects reflected light from the sheet is used as the sheet leaning sensor 450. The support wall 430 is provided with a window portion 430*b*, i.e., opening portion, that transmits light from the light emitting portion of the sheet leaning sensor 450 and reflected light from the sheet. The signal, i.e., voltage value, generated by the light receiving portion varies according to the amount of light received by the light receiving portion. The sheet leaning sensor 450 is an example of a sensor including a light emitting portion that emits light to the exterior of the casing 201 through the opening portion and a light receiving portion that outputs a signal corresponding to the light reflected on a target object at the exterior of the casing 201 and entered through the opening portion. The target object can also be an object other than sheets.

The sheet leaning sensor 450 is arranged lower than a track through which the sheet having passed through the nip portion of the lower sheet discharge roller 230 is discharged. Further, the sheet leaning sensor 450 is arranged to detect sheets at a position above the stacking surface 401*a* of the lower sheet discharge tray 401 positioned at the initial position. In the present embodiment, the sheet leaning sensor 450 is arranged in a vicinity of the lower end of the lower sheet discharge roller 230.

In a state where there is a sheet, referred to as a leaning sheet, leaning on the support wall 430, the light emitted by the light emitting portion of the sheet leaning sensor 450 is reflected by the sheet and enters the light receiving portion. Meanwhile, if there is no sheet leaning on the support wall 430, no reflected light from the sheet will enter the sheet leaning sensor 450, such that the amount of light received by the light receiving portion is reduced at least compared to the case where there is a leaning sheet. The light receiving portion is configured to output either an analog signal corresponding to the amount of received light or a binary signal corresponding to whether the amount of received light is greater than a predetermined threshold value. In any case, the control unit 250 (FIG. 1) of the postprocessing apparatus 200 can determine whether there is a leaning sheet present on the lower sheet discharge tray 401 based on the detection signal from the sheet leaning sensor 450.

The sheet leaning sensor 450 is configured to detect the presence or absence of a sheet at a predetermined height position, such that it can also serve as a sensor for outputting a detection signal corresponding to whether a trailing edge portion of the sheet has passed a predetermined height position.

Control Example

One example of a method for controlling the lower sheet discharge tray 401 using the sheet presence sensor 442 and the sheet leaning sensor 450 will be described. At a point of time when a series of actions, that is, image forming job, in which the image forming system 1 forms an image on a sheet and discharges the sheet to the lower sheet discharge tray 401 is started, the lower sheet discharge tray 401 is assumed to be positioned at the initial position. The control unit 250 can confirm that there is no sheet on the lower sheet discharge tray 401 based on the detection signal of the sheet presence sensor 442.

In a state where an image forming job is started and a first sheet is discharged onto the lower sheet discharge tray 401, the detection signal of the sheet presence sensor 442 is switched. Thereby, the control unit 250 detects that a sheet has been stacked on the lower sheet discharge tray 401. Thereafter, the control unit 250 outputs a command to a lifting/lowering motor of the lower sheet discharge tray 401 to lower the lower sheet discharge tray 401 for a predetermined distance whenever a predetermined number of sheets have been accumulated on the sheets discharged to the lower sheet discharge tray 401. Thereby, the upper surface height of sheets stacked on the lower sheet discharge tray 401 can be maintained to a roughly constant height.

Meanwhile, if a signal representing sheet detection is output by the sheet leaning sensor 450 during execution of the image forming job, the control unit 250 outputs a command to the lifting/lowering motor to lower the lower sheet discharge tray 401. Thereafter, if the signal output by the sheet leaning sensor 450 is switched to a signal representing that no sheet is detected, the control unit 250 stops the lowering of the lower sheet discharge tray 401. Thereby, it becomes possible to prevent the sheets being discharged from the lower sheet discharge roller 230 from colliding against the leaning sheet and falling from the lower sheet discharge tray 401 or causing misalignment of sheets on the lower sheet discharge tray 401.

One example of a control performed by the control unit 250 has been escribed above, and the control unit 250 can perform control of the lower sheet discharge tray 401 by also referring to detection signals from sensors other than the sheet presence sensor 442 and the sheet leaning sensor 450.

Other Sensors

The sheet presence sensor 442 described above is an example of a sensor that outputs a detection signal according to whether a sheet is present or absent on the lower sheet discharge tray 401. The sensor is not limited to a photosensor having light shielded by the sheet presence flag 441, and any sensor for detecting movement of the sheet presence flag, such as a mechanical switch or a capacitance-type proximity sensor, can be used as the sheet presence sensor 442. Further, a sensor that directly detects the movement of the sheet presence lever 440 can be used instead of the sensor for detecting movement of the sheet presence flag 441 that moves in linkage with the sheet presence lever 440. For example, a photo-interrupter can be arranged at a position where light is shielded by the flag abutment portion 440*b* of the sheet presence lever 440 according to the present embodiment.

Further, a sheet presence sensor outputting a detection signal according to the presence or absence of a sheet on the lower sheet discharge tray 401 can be disposed on the lower sheet discharge tray 401. Specifically, a photo-interrupter that is shielded by a part of the sheet presence lever 440, or a photo reflector that emits light to an upper direction of the stacking surface 401*a* and detects reflected light from the sheet, can be arranged in the interior of the lower sheet discharge tray 401. In that case, a length of a cable harness W that is connected to the sheet presence sensor 442 described below is given sufficient margin so as to tolerate the positional changes of the sheet presence sensor 442 accompanying the lifting and lowering of the lower sheet discharge tray 401.

The sheet leaning sensor 450 described above is an example of a sensor that outputs detection signals according to the presence or absence of leaning of a sheet on the lower sheet discharge tray 401. As another configuration, for example, a photosensor that detects the swinging of a flag projected from the support wall 430 or a distance measurement sensor disposed above the lower sheet discharge roller 230 for detecting the distance in the height direction to a trailing edge portion of the highest sheet can be adopted as the sheet leaning sensor.

Wiring Path of Sensors

A wiring path of the sheet presence sensor 442 and the sheet leaning sensor 450 mentioned above will be described. As illustrated in FIG. 4, the sheet presence sensor 442 and the sheet leaning sensor 450 are attached to a rear surface of the support wall 430, that is, inner side surface of the casing 201. The sheet presence sensor 442 and the sheet leaning sensor 450 are electrically connected with the control unit 250 of the postprocessing apparatus 200 via a cable harness W wired along the support wall 430.

The cable harness W is an example of an electric cable or a bundle of cables including a conductor or conducting wire for transmitting signals or power and an insulator or insulation covering the conductor. For example, FIG. 8A includes an arrow denoting the location of the covered conductor/conducting wire. The cable harness W according to the present embodiment includes a signal line for transmitting the signals output from the sheet presence sensor 442 and the sheet leaning sensor 450 to the control unit 250, and a power line, i.e., power supply line, for supplying power to the sheet presence sensor 442 and the sheet leaning sensor 450.

The cable harness W is a branched cable including a trunk line W0, and a first branch line W1 and a second branch line W2 being branched from the trunk line W0 at a branch portion Wb. The first branch line W1 is connected to the sheet presence sensor 442, and the second branch line W2 is connected to the sheet leaning sensor 450.

In the present embodiment, the sheet presence sensor 442 and the sheet leaning sensor 450 are arranged one above the other at a center portion of the support wall 430 in the X axis direction. That is, an installation range of a sensor substrate of the sheet presence sensor 442 in the X axis direction and an installation range of a sensor substrate of the sheet leaning sensor 450 in the X axis direction are overlapped, and the sheet presence sensor 442 is positioned lower than the sheet leaning sensor 450. When viewed in the Z axis direction, the sheet presence sensor 442 and the sheet leaning sensor 450 are at least partially overlapped.

The first branch line W1 of the cable harness W is extended upward from a connector portion of the sheet presence sensor 442, and the second branch line W2 is extended downward from a connector portion of the sheet leaning sensor 450. Then, the first branch line W1 and the second branch line W2 merge at the branch portion Wb and become the trunk line W0. The trunk line W0 is extended in the X axis direction along the support wall 430 and is connected to the control unit 250 via a relay connector and the like.

The trunk line W0 is laid from the end portion of the support wall 430 in the X axis direction along the rear frame 201R in a curved manner. The rear frame 201R according to the present embodiment has an L-shaped cross section in top view, and includes a first portion 201Ra that extends in the Y axis direction approximately perpendicularly to the support wall 430, and a second portion 201Rb that extends in the X axis direction approximately perpendicularly to the first portion 201Ra. Accordingly, the trunk line W0 is wired along a corner portion, i.e., external corner, between the support wall 430 and the first portion 201Ra of the rear frame 201R and a corner portion, i.e., internal corner, between the first portion 201Ra and the second portion 201Rb of the rear frame 201R.

Cable Guide

A configuration for wiring the cable harness W along the wiring path described above will be described. In the present embodiment, the cable harness W is supported by a guide member formed of a curved metal wire, i.e., wire-forming, and the guide member is attached to the casing 201, by which the cable harness W is wired.

In the present embodiment, a guide wire formed by processing a metal wire having a circular cross section with a wire diameter of 0.5 mm to 1.0 mm using a wire-forming machine, for example, is adopted as the guide member. The metal material constituting the guide wire is not specifically limited, but for example, an aluminum wire, an iron wire, a stainless-steel wire, or a copper alloy wire containing brass or phosphor bronze can be used. Further, a flexural rigidity of the guide wire should at least be higher than the flexural rigidity of the electric cable being guided thereby.

As illustrated in FIG. 4, according to the present embodiment, a first guide wire 460 that guides the first branch line W1 of the cable harness W and a second guide wire 470 that guides the trunk line W0 of the cable harness W are used. Each of the first guide wire 460 and the second guide wire 470 is a wire-forming member, i.e., wire forming, that is formed by subjecting one metal wire to plastic deformation. Wire forming includes right-angled bending, bending along a smooth curve, and helical bending or coiling. Processing other than bending, such as thread cutting, punching, and chamfering, can be performed to a part of the wire-forming member. The first guide wire 460 serves as a first guide member for guiding a part of the electric cable, and the second guide wire 470 functions as a second guide member for guiding a different part of the electric cable.

By using the guide member formed by wire-forming a metal wire and having at least one of the electric cable and the guide member twist around the other, the electric cable is retained by the guide member, and by attaching the guide member to the casing, the electric cable is wired. Thereby, as described in detail below, the workability of the wiring operation can be improved while reducing the space required for wiring.

Details of a guide wire according to the present embodiment will be described below. As illustrated in FIG. 4, the first guide wire 460 includes a vertical guide portion 464 extended in an approximately vertical direction, i.e., Z axis direction, which guides the first branch line W1 of the cable harness W along a direction in which the vertical guide portion 464 extends. The second guide wire 470 includes a horizontal guide portion 473 that extends in an approximately horizontal direction, i.e., X axis direction, and guides the trunk line W0 of the cable harness W along a direction in which the horizontal guide portion 473 extends. In other words, according to the present embodiment, a main wiring direction of the first branch line W1 also referred to as a first direction is the up-down direction, i.e., Z axis direction, and a main wiring direction of the trunk line W0 also referred to as a second direction is the horizontal direction, i.e., X axis direction.

Since the second branch line W2 of the cable harness W is short, according to the present embodiment, there is no guide member provided to guide the second branch line W2. If the length of the second branch line W2, that is, the length along a center line of the second branch line W2 from the branch portion Wb to the connector portion of the sheet leaning sensor 450, is considerably long, it may be possible to additionally provide a guide wire for guiding the second branch line W2.

(1) First Guide Wire 460

Figure 5:
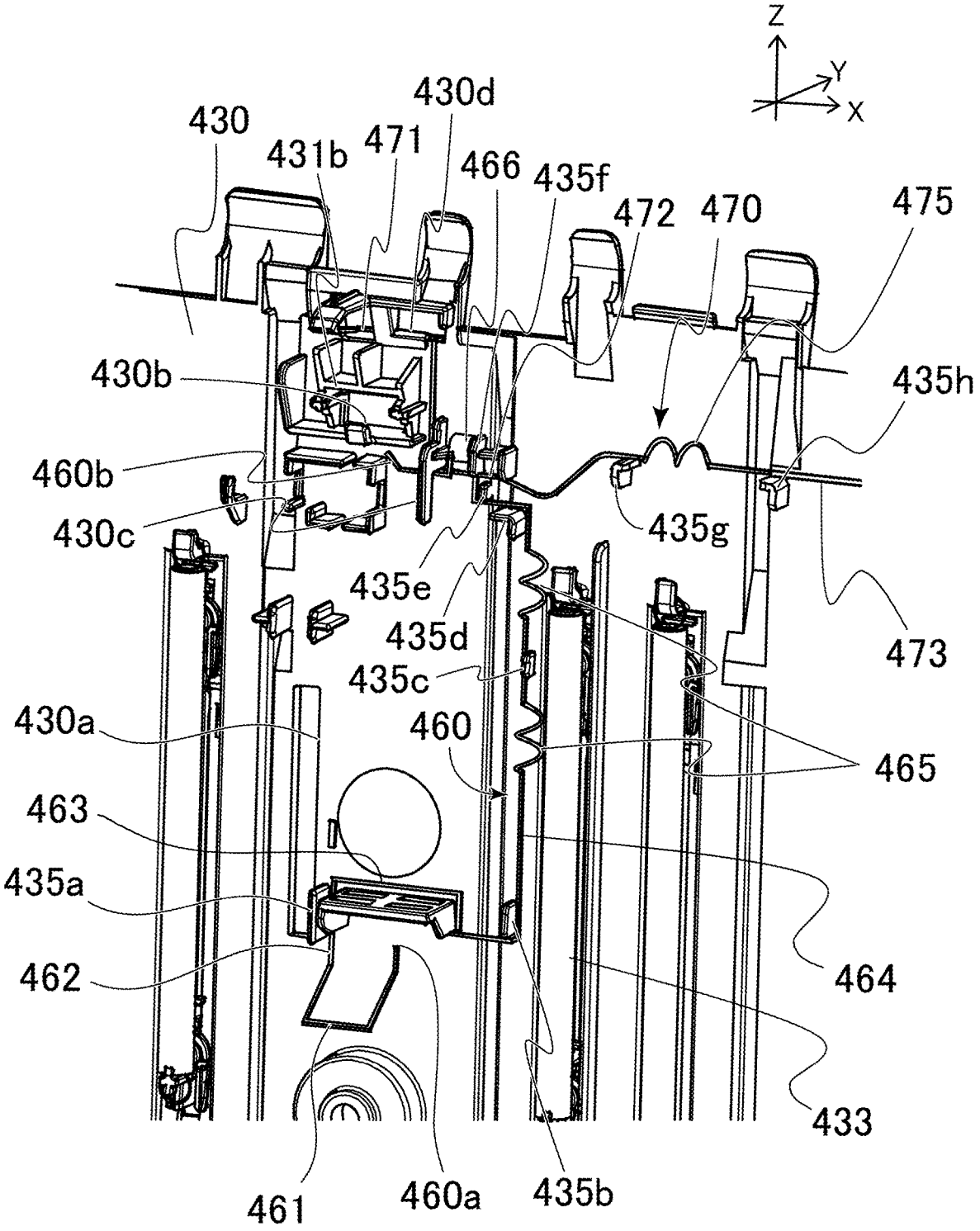
FIG. 5 is a perspective view illustrating a guide member according to the first embodiment.

FIG. 5 illustrates a state in which the first guide wire 460 and the second guide wire 470 are attached to the support wall 430, with the cable harness W, the sheet presence sensor 442, and the sheet leaning sensor 450 not shown.

As illustrated in FIG. 5, the first guide wire 460 includes a frame contact portion 461, a vertical portion 462, a horizontal portion 463, the vertical guide portion 464, at least one helical portion 465, and a pressure contact portion 466.

The frame contact portion 461 of the first guide wire 460 is positioned below an attaching portion 431*a* of the support wall 430 on which the sheet presence sensor 442 is attached. The frame contact portion 461 is extended obliquely with respect to the support wall 430 from an end 460*a* of the metal wire toward the lower direction in a direction separating from the support wall 430, that is, frontward direction in the drawing in the Y axis direction, then bent approximately perpendicularly at two areas and returning to support wall 430, thereby forming an approximately U-shaped form.

In a state where the support wall 430 is assembled as a part of the casing 201, the frame contact portion 461 is arranged to come into contact with a sheet metal frame 201M (refer to FIG. 2) that constitutes a frame body of the postprocessing apparatus 200. The sheet metal frame 201M is an example of a conductive member that is electrically grounded, wherein the conductive member ca be a resin member having metal plated thereon or a sheet or wire material made of metal that is attached to the frame body.

The sheet metal frame 201M is arranged on an inner side of the casing 201 with respect to the support wall 430 at a position opposed to the support wall 430 in the Y axis direction. Further, the sheet metal frame 201M is electrically grounded. Therefore, the frame contact portion 461 having elasticity in the Y axis direction ensures electrical conduction of the first guide wire 460 with the sheet metal frame 201M opposed to the support wall 430 in the Y axis direction. Thereby, the first guide wire 460 is electrically grounded via the sheet metal frame 201M. In other words, the approximately U-shaped form of the frame contact portion 461 is one example of an elastic shape which generates elastic force for causing the frame contact portion 461, i.e., contact portion of the guide member, to be in pressure contact with the sheet metal frame 201M, i.e., conductive member.

The elastic shape causing the contact portion of the guide member to be in pressure contact with the conductive member is not limited to this example, and for example, the end portion of the first guide wire 460 can be simply bent with respect to the vertical portion 462 away from the support wall 430 toward the lower direction from the vertical portion 462. Further, the frame contact portion 461 can be formed as a coil spring capable of extending and contracting in the Y axis direction.

The vertical portion 462 extends upward in the approximately vertical direction from the frame contact portion 461 and passes through the space between the sheet presence sensor 442 and the slit 430*a* through which the sheet presence flag 441 passes. The horizontal portion 463 is extended approximately horizontally, in the X axis direction, along the attaching portion 431*a* on which the sheet presence sensor 442 is attached.

The vertical guide portion 464 extends upward in the approximately vertical direction from the horizontal portion 463. Two helical portions 465 are arranged in the vertical guide portion 464. Each helical portion 465 has a helical shape, that is, coiled portion, in which the metal wire serving as the material is wound helically for at least one turn or more, that is, 360° or more. The portions other than the helical portion 465 of the vertical guide portion 464 is an extended portion that extends in the vertical direction serving as a wiring direction of the first branch line W1.

The helical portion 465 is a part that retains the first branch line W1 by having the first guide wire 460 twist around (i.e., turn around or roll around) the first branch line W1 (refer to FIG. 4). In the description, the term "twisted around" refers to a state in which two elongated members, or thin thread members, that extend approximately in the same direction are intertwined with each other such that they are not easily separated even if they are relatively moved in an arbitrary direction intersecting the extending direction. In other words, a state in which one, referred to as $\alpha$, of two thread members a and B is twisted around the other, referred to as $\beta$, refers to a state in which there is at least one part where $\alpha$ and $\beta$ intersect one another at the front side of $\beta$ when viewed from any direction of 360° within a plane orthogonal to the extending direction of $\alpha$ and $\beta$.

By setting the number of turns of each of the helical portions 465 to one or more, a state in which the first branch line W1 is retained by the first guide wire 460 with the helical portion 465 twisted around the first branch line W1 can be realized. That is, with the helical portion 465 twisted around the first branch line W1, even if the first branch line W1 attempts to move in a direction intersecting the extending direction, i.e., Z axis direction, of the vertical guide portion 464 of the first guide wire 460, the separation of the first branch line W1 can be prevented by the helical portion 465.

By increasing the number of turns of the helical portion 465, it becomes possible to limit the inclination of the first branch line W1 at the helical portion 465 and to further reduce the risk of the first branch line W1 falling from the first guide wire 460. Meanwhile, if the number of turns for each of the helical portions 465 or the number of helical portions 465 being provided is increased excessively, the work related to twisting the helical portion 465 around the first branch line W1 becomes too troublesome.

According to the present embodiment, by arranging helical portions 465 having approximately two turns at two areas distant from one another, the helical portions 465 can firmly retain the first branch line W1 and prevent falling of the first branch line W1 while suppressing the number of turns and number of areas of the helical portions 465. The number of turns of the helical portion 465 provided at one area is preferably 1 turn or greater and 5 turns or smaller, and even more, it is preferably 1.5 turns or greater and 3 turns or smaller. It is also possible to have three or more helical portions 465 provided on the vertical guide portion 464, and even further, the entire vertical guide portion 464 can be formed as one continuous helical shape.

The pressure contact portion 466 is provided at a portion extending from the upper end of the vertical guide portion 464 in a bent manner in the X axis direction. The pressure contact portion 466 is a portion that utilizes the elasticity of the metal wire constituting the first guide wire 460 to abut against the second guide wire 470 and ensure electrical conduction. The pressure contact portion 466 according to the present embodiment has a shape of a torsion coil spring and adopts a configuration to acquire reaction force from the support wall 430 by hanging an end 460*b* of the first guide wire 460 to a spring hook portion 430*c* of the support wall 430. That is, the torsion coil spring-shape of the pressure contact portion 466 is an example of an elastic shape that generates elastic force for enabling pressure contact between a first guide wire, i.e., first guide member, and an abutment portion 472, i.e., contact portion.

The elastic shape for realizing the pressure contact between the first guide member and the contact portion of a second guide member is not limited to the torsion coil spring. For example, it is possible to adopt a wire clip shape, such as a paper clip formed of a looped wire, as the pressure contact portion 466 and to nip the abutment portion 472 of the second guide wire 470 by the clip. Further, it is also possible to adopt a bent shape such as the frame contact portion 461 as the pressure contact portion 466 and hang the tip portion of the bent shape to a rib provided on the support wall 430 to thereby generate contact pressure against the abutment portion 472. It is also possible to have the second guide wire 470 adopt the elastic shape for causing the abutment portion 472 to be in pressure contact with the first guide wire 460.

(2) Second Guide Wire 470

As illustrated in FIG. 5, the second guide wire 470 includes a horizontal portion 471, the abutment portion 472, the horizontal guide portion 473, at least one helical portion 475, and a hook portion 474 (FIG. 4).

The horizontal portion 471 is a portion that extends from an end portion of the second guide wire 470 hooked to the hole on the support wall 430 through a space formed between the support wall 430 and the sheet leaning sensor 450 attached to an attachment portion 431*b* toward an approximately horizontal direction, i.e., X axis direction. The abutment portion 472 is a portion that bends downward in a clank shape from the horizontal portion 471 and extending again in the approximately horizontal direction. The abutment portion 472 is a portion that abuts against the pressure contact portion 466 of the first guide wire 460. By the abutment portion 472 being abutted against the pressure contact portion 466, the electrical conduction between the second guide wire 470 and the first guide wire 460 is ensured, and the second guide wire 470 is electrically grounded via the first guide wire 460.

The horizontal guide portion 473 is a portion that extends in an approximately horizontal direction, i.e., X axis direction, from the abutment portion 472. Three helical portion 475 are arranged on the horizontal guide portion 473 in a manner spaced apart from one another. Each of the helical portions 475 is coil shaped, i.e., coiled portion, that is formed by winding a metal wire serving as the material for at least one turn, i.e., 360°, or more in a helical shape. The portions of the horizontal guide portion 473 other than the helical portions 475 are extended linearly in an approximately horizontal direction.

The helical portion 475 is a portion that retains the first branch line W1 by the second guide wire 470 twisting around the trunk line W0 (refer to FIG. 4). In the present embodiment, the helical portion 475 turned for approximately two turns, that is, 1 turn or more and 3 turns or less, is arranged at three areas spaced apart from one another, such that the helical portion 475 is downsized as much as possible while retaining the trunk line W0 by the helical portion 475 steadily and preventing the trunk line W0 from falling. It is also possible to arrange 4 or more, or 2 or less, helical portions 475 in the horizontal guide portion 473, or to form the entire horizontal guide portion 473 as one continuous helical portion 475.

The hook portion 474 is arranged at the tip of the horizontal guide portion 473 (FIG. 4). The hook portion 474 is hook-shaped such that the end portion of the second guide wire 470 can be hooked on and fixed to a part of the casing 201.

(3) Rib for attaching Guide Wire

A plurality of ribs 435*a* to 435*k* are provided on the support wall 430 as projections for attaching the first guide wire 460 and the second guide wire 470 to the casing 201 (FIGS. 4 and 5). The ribs 435*a* to 435*k* can be formed integrally with the support wall 430 by using a common resin material as the support wall 430.

As illustrated in FIG. 5, the rib 435*a* is provided between the attaching portion 431*a* of the sheet presence sensor 442 and the slit 430*a* for the sheet presence flag 441, and sets a position of the vertical portion 462 in the X axis direction of the first guide wire 460. The rib 435*b* sets a position of the bent portion of the first guide wire 460 between the horizontal portion 463 and the vertical guide portion 464. The rib 435*c* is provided between the two helical portions 465 of the first guide wire 460 and between the vertical guide portion 464 and one of the tension springs 433 for the sliding walls, and sets a position of the vertical guide portion 464 in the X axis direction. The ribs 435*d* and 435*e* set the position of the bent portion of the first guide wire 460 between the vertical guide portion 464 and the pressure contact portion 466. The rib 435*f* sets a position in the X axis direction of the pressure contact portion 466 of the first guide wire 460 together with the spring hook portion 430*c*. The ribs 435*a* to 435*f* and the spring hook portion 430*c* enable the first guide wire 460 to be retained without falling from the support wall 430.

The vertical guide portion 464 of the first guide wire 460 is positioned in the X axis direction by being sandwiched from both sides in the X axis direction by the ribs 435*b*, 435*c*, and 435*d*. Further, the vertical guide portion 464 is positioned in the Z axis direction by having its bent portion retained by the ribs 435*b* and 435*d*. Further, the vertical guide portion 464 is positioned at a position in contact with or adjacent to the support wall 430 with respect to the Y axis direction by having both end portions of the first guide wire 460 fixed to the support wall 430 as described later.

As described, by having the vertical guide portion 464 positioned with respect to the support wall 430, the wiring path of the cable harness W guided by the vertical guide portion 464 is determined. The configuration is not limited to the example where the vertical guide portion 464 is directly in contact with and positioned by the ribs 435*b* to

435*d*, and the vertical guide portion 464 and the cable harness W can be positioned by having the cable harness W retained by the vertical guide portion 464 contact the ribs 435*b* to 435*d*.

The heights of the ribs 435*b* to 435*d*, that is, height in which the ribs are protruded in the Y axis direction from the support wall 430, arranged along the vertical guide portion 464 should preferably be as low as possible within the range capable of retaining the vertical guide portion 464 stably. For example, the heights of the ribs 435*b* to 435*d* can be set to approximately the same as or shorter than an outer diameter of the helical portion 465. Thereby, it becomes possible to suppress the space required for wiring the cable harness W from being substantially increased by the presence of the ribs 435*b* to 435*d*.

Further, as illustrated in FIG. 5, the ribs 435*e* and 435*f* set the position of the abutment portion 472 of the second guide wire 470 in the Z axis direction. The ribs 435*g* and 435*h* support the horizontal guide portion 473 of the second guide wire 470 from below and set the position thereof in the Z axis direction. As illustrated in FIG. 4, the rib 435*i* has a surface that presses the horizontal guide portion 473 of the second guide wire 470 from above and a surface opposed to the support wall 430 in the Y axis direction, setting the positions of the horizontal guide portion 473 in the Z axis direction and the Y axis direction. The rib 435*j* presses the horizontal guide portion 473 of the second guide wire 470 from above and sets the position of the horizontal guide portion 473 in the Z axis direction. The rib 435*k* is a part on which the hook portion 474 of the second guide wire 470 is hung. These ribs 435*e* to 435*k* enable the second guide wire 470 to be retained without falling from the support wall 430.

The horizontal guide portion 473 of the second guide wire 470 is positioned in the Z axis direction by having the lower surface thereof supported by the ribs 435*g* and 435*h* and pressed from above by the ribs 435*i* and 435*j*. Further, the horizontal guide portion 473 is positioned at a position abutted against or adjacent to the support wall 430 in the Y axis direction by the hook-shaped rib 435*i*. Further, the horizontal guide portion 473 is positioned in the X axis direction by having both end portions of the second guide wire 470 fixed to the support wall 430 as described below. As described, by having the horizontal guide portion 473 positioned with respect to the support wall 430, the wiring path of the cable harness W guided by the horizontal guide portion 473 is determined. The configuration is not limited to the example in which the horizontal guide portion 473 is positioned by being directly abutted against the ribs 435*g* to 435*j*, and the horizontal guide portion 473 and the cable harness W can be positioned by having the cable harness W retained by the horizontal guide portion 473 abut against the ribs 435*g* to 435*j*.

The heights of the ribs 435*g* to 435*j*, that is, protruding height in the Y axis direction from the support wall 430, arranged along the horizontal guide portion 473 should also preferably be as low as possible within the range capable of retaining the horizontal guide portion 473 stably. For example, the heights of the ribs 435*g*, 435*h*, and 435*j* can be set to approximately the same as or smaller than the outer diameter of the helical portion 475. Thereby, the space required for wiring the cable harness W can be suppressed from being substantially increased by the presence of the ribs 435*g*, 435*h*, and 435*j*.

As described, since at least a part, or even all, of the projections for fixing the guide member, which are the ribs 435*a* to 435*k*, are molded integrally with the support wall 430, manufacturing costs and number of steps can be cut down compared to the case where members for fixing the guide members are provided individually from the support wall 430. Further, since the space occupied by the projections, which are the ribs 435*a* to 435*k*, is extremely small, the space required to wire the cable harness W can be cut down even further compared to a case where members for fixing the guide members are provided individually from the support wall 430.

The first guide wire 460 and the second guide wire 470 are members that are formed by bending a wire in advance according to the shape to be assembled defined by the ribs 435*a* to 435*k*. For example, the first guide wire 460 has bent portions that have been bent approximately perpendicularly at positions corresponding to corner portions of the ribs 435*b*, 435*d*, and 435*e* in a state after being attached to the support wall 430. The helical portions 465 and 475 mentioned above also have a coiled shape that has been formed when creating the first guide wire 460 and the second guide wire 470.

Method for Attaching Cable Harness and Guide Wire

A method for attaching the sheet leaning sensor 450, the sheet presence sensor 442, the first guide wire 460, the second guide wire 470, and the cable harness W to the support wall 430 will be described with reference to FIGS. 4 and 5.

(1) At first, one of two end portions of the second guide wire 470 is attached to the support wall 430 as temporary fixing of the second guide wire 470. That is, one of the end portions of the second guide wire 470 is fixed to the support wall 430 by passing the horizontal portion 471 of the second guide wire 470 from a rear surface side of the support wall 430 through a hole 430*d* on the support wall 430. Thereby, one of the end portions of the second guide wire 470 is retained by the hole 430*d* serving as a first retaining portion. Further, the abutment portion 472 of the second guide wire 470 is abutted against the rear surface of the support wall 430 and the horizontal guide portion 473 is extended approximately in the X axis direction along the rear surface of the support wall 430. In this state, the hook portion 474 positioned at the other end portion of the second guide wire 470 is kept free without being fixed to the support wall 430.

(2) The first branch line W1 is attached to the first guide wire 460, that is, the first branch line W1 and the first guide wire 460 are integrated. In other words, the cable harness W having the first branch line W1 connected to the connector portion of the sheet presence sensor 442 is held by hand, and the helical portion 465 on the upper side of the first guide wire 460 is wound around the area close to the branch portion Wb of the first branch line W1. Specifically, the first branch line W1 is fit to an opened part of the helical portion 465, and thereafter, the first branch line W1 is pushed into the inner side of the helical portion 465 while winding the first branch line W1 and the sheet presence sensor 442 in the helix direction of the helical portion 465. Thereby, the helical portion 465 is twisted around the first branch line W1. A similar operation is performed for the other helical portion 465. Thereby, the first branch line W1 is retained by the first guide wire 460 with each of the helical portions 465 twisted around the first branch line W1.

(3) One of the end portions of the first guide wire 460 is attached to the support wall 430 as temporary fixing of the first guide wire 460. That is, the frame contact portion 461 of the first guide wire 460 is positioned below the attaching portion 431*a* of the sheet presence sensor 442, the vertical portion 462 is positioned on the side of the attaching portion 431*a*, and the horizontal portion 463 is positioned above the attaching portion 431*a*.

(4) The sheet presence sensor 442 is attached to the support wall 430. That is, with the frame contact portion 461 of the first guide wire 460 positioned as described in (3), the sheet presence sensor 442 is fixed to the attaching portion 431*a* by screwing or snap-fitting. Thereby, one of the end portions of the first guide wire 460 is retained in the space between the wall surface of the support wall 430, the attaching portion 431*a*, and the sheet presence sensor 442, i.e., the first retaining portion.

(5) The remaining part of the first guide wire 460 is attached to the support wall 430 as proper fixing of the first guide wire 460. That is, the vertical guide portion 464 of the first guide wire 460 retaining the first branch line W1 is laid along the ribs 435*b* to 435*d*. Then, with the pressure contact portion 466 of the first guide wire 460 overlapped with the abutment portion 472 of the second guide wire 470, the end portion of the first guide wire 460 is hung on the spring hook portion 430*c* of the support wall 430 and fixed thereto. Thereby, the other end portion of the first guide wire 460 will be retained by the spring hook portion 430*c* serving as a second retaining portion. Further, an arm portion opposite to the spring hook portion 430*c* of the pressure contact portion 466 which is a torsion coil spring comes to be in pressure contact with the abutment portion 472, such that conduction of the first guide wire 460 and the second guide wire 470 is ensured. Further, by having both end portions of the first guide wire 460 fixed, the first branch line W1 will be in a state guided by the vertical guide portion 464 and wired along the support wall 430.

(6) The sheet leaning sensor 450 is attached to the support wall 430. That is, the sheet leaning sensor 450 is fixed to the attachment portion 431*b* of the support wall 430 by screwing or snap-fitting.

(7) The trunk line W0 is attached to the second guide wire 470, that is, the trunk line W0 and the second guide wire 470 are integrated. In other words, each of the helical portions 475 provided on the horizontal guide portion 473 of the second guide wire 470 are wound around the trunk line W0 of the cable harness W. In this state, since the other end portion of the second guide wire 470, that is, the hook portion 474, is not fixed to the support wall 430, such that the helical portion 475 can be easily wound around the trunk line W0 in a similar method as that described in (2). Thereby, the trunk line W0 is retained by the second guide wire 470 with each of the helical portions 475 twisted around the trunk line W0.

(8) The remaining part of the second guide wire 470 is attached to the support wall 430 as proper fixing of the second guide wire 470. That is, the horizontal guide portion 473 of the second guide wire 470 retaining the trunk line W0 is laid along the ribs 435*g* to 435*j*. Then, the hook portion 474 of the second guide wire 470 is hooked to the rib 435*k* serving as the second retaining portion and fixed thereto. By having both end portions of the second guide wire 470 fixed, the trunk line W0 will be in a state guided by the horizontal guide portion 473 and wired along the support wall 430.

Advantages of Present Embodiment

As described above, according to the present embodiment, the electric cable, i.e., the cable harness W, is retained by guide members, i.e., the first guide wire 460 and the second guide wire 470, which are wire-forming members formed of a wire material made of metal, and the guide members are attached to the casing 201 to thereby allow the electric cable to be wired. In the attached state, the first guide wire 460 and the second guide wire 470 retain the cable harness W by being twisted around the cable harness W. Therefore, the space required to arrange the cable harness W can be reduced compared to a case where resin guides having U-shaped cross-sections are continuously arranged along the wiring path of the cable harness W.

Further, by twisting the helical portions 465 and 475 of the first guide wire 460 and the second guide wire 470 around the cable harness W and attaching the first guide wire 460 and the second guide wire 470 to the casing 201, the cable harness W can be wired on the casing 201. Therefore, the workability of wiring the cable harness W can be improved compared to a configuration where the cable harness W must be nipped by or hooked on a large number of projections formed on the casing 201.

Especially according to the present embodiment, an occupation volume in which the cable harness W is retained by the first guide wire 460 and the second guide wire 470, which are the vertical guide portion 464 and the horizontal guide portion 473, is approximately equivalent to a volume of a cylinder having the same outer diameter as the helical portions 465 and 475. Therefore, the space required for wiring the cable harness W can be further reduced.

Further, the first guide wire 460 and the second guide wire 470 are each formed in a shape capable of having the helical portions 465 and 475 twisted around the cable harness W in a state where one end portion of the guide wire is retained by the support wall 430 and the other end portion of the guide wire is not retained by the support wall 430. That is, the shape, i.e., pitches and number of turns, of the helical portion 465 is determined such that the helical portion 465 can be easily twisted around the first branch line W1 by turning the other end portion of the first guide wire 460 around the first branch line W1. Similarly, the shapes, i.e., pitches and number of turns, of the helical portion 475 is determined such that the helical portion 475 can be easily twisted around the trunk line W0 by turning the other end portion of the second guide wire 470 around the trunk line W0. According to such configuration, the operation for having the cable harness W retained by the first guide wire 460 and the second guide wire 470 can be performed at positions distant from the support wall 430, such that the operation space is easily ensured and the workability is enhanced.

Further according to the present embodiment, as illustrated in FIG. 5, the first branch line W1 and one of the tension springs 433 for the sliding walls 432 are arranged adjacently. The sliding walls 432 and the sheet presence sensor 442 at the connection destination of the first branch line W1 correspond to various sizes of sheets, such that they are preferably arranged near the center of the support wall 430 in the X axis direction. According to this arrangement, the space required for the wiring of the first branch line W1 is small, such that the first branch line W1 can be wired through the space formed between the sheet presence sensor 442 and the tension spring 433 in the X axis direction.

In the arrangement where the sliding walls 432 are arranged close to the first branch line W1, if the first branch line W1 comes into contact with the sliding walls 432 during movement of the sliding walls 432, for example, the insulator of the first branch line W1 may be worn, and the conductor arranged therein may be exposed, causing short circuit. Regarding this drawback, according to the present embodiment, the first branch line W1 is wired through the inner side of two helical portions 465, such that the first branch line W1 is retained approximately in parallel with the tension spring 433. Thereby, the first branch line W1 and the sliding walls 432 are prevented from being in contact with each other, and the first branch line W1 can be protected from the tension spring 433 serving as the movable part.

Further, a sheet metal frame not shown of the sheet processing apparatus is adjacently arranged on the rear side of the horizontal guide portion 473 of the second guide wire 470. In order to protect the cable harness W from the edge of the sheet metal frame, helical portions 475 can be arranged at three areas in midway of the horizontal guide portion 473. Since the horizontal guide portion 473 is longer than the vertical guide portion 464 of the first guide wire 460, the number of helical portions 475 are increased to three so as to prevent sagging of the cable harness W between the helical portions. According to this configuration, even if the edge of the sheet metal frame comes into contact with the surface of the helical portion 475, the trunk line W0 passing through the inner side of the helical portion 475 can be prevented from being in contact with the edge of the sheet metal frame and damaged thereby.

Incidentally, the inner diameter of the helical portion 465 is set with some margin from the diameter of the first branch line W1. The outer diameter of the helical portion 465 is a value having added twice the wire diameter of the wire material used as the material of the first guide wire 460 to the inner diameter.

In the case of a guide made of resin, a total amount of a thickness of a base portion of the guide attached to the support wall 430, a thickness of the hook shape protruded from the base portion, and a space between the base portion and the hook shape through which the cable harness is passed, is the thickness required for wiring. The thicknesses of the base portion and the hook shape are varied according to the required strength or fire-resistance, and for example, it is approximately between 1.0 mm and 1.6 mm. Therefore, when a cable harness having a diameter of 3 mm is used, a thickness of 7.2 mm was required for wiring the cable harness, assuming that the width of the space through which the cable harness is passed is 4 mm and the thickness of the base portion and hook shape is 1.6 mm. The thickness is increased further if reinforcement ribs are formed to ensure the strength of the hook portions.

Meanwhile, according to the present embodiment, the first guide wire 460 is formed by a wire having a wire diameter of 0.5 mm, for example, and the first branch line W1 is retained by the helical portions 465. In this case, even if the inner diameter of the helical portion 465 is set to 4 mm, which is the same width as the space between the base portion and hook shape described earlier, the thickness of the helical portion 465 can be as small as 5.0 mm, such that a reduction of thickness of 2.2 mm is enabled. The sheet metal frame of the postprocessing apparatus 200 and the mechanism within the apparatus are arranged on the rear surface of the support wall 430, such that by reducing the necessary thickness for wiring the cable harness W, that is, the width occupied in the Y axis direction, the space within the casing 201 can be utilized efficiently while protecting the cable harness W.

Further according to the present embodiment, the first guide wire 460 is made to come into contact with a sheet metal frame 201M of the casing 201 and grounded. Since the first guide wire 460 made of the metal wire is grounded, the first guide wire 460 can be provided with a function to cope with electrostatic discharge (ESD). Further, since the second guide wire 470 is grounded via the first guide wire 460, the second guide wire 470 can also be provided with a function to cope with ESD.

Specifically, according to the present embodiment, sensors, which are the sheet presence sensor 442 and the sheet leaning sensor 450, formed to detect the sheet on the outer side of the support wall 430 through the opening portions, which are the slit 430*a* and the window portion 430*b*, formed on the support wall 430 are used. According to this configuration, a portion, that is, the vertical portion 462, that passes the circumference of the opening portion, i.e., the slit 430*a*, along the support wall 430 is provided on the first guide wire 460, independently from the portion, i.e., the vertical guide portion 464, for guiding the cable harness W. Further, the second guide wire 470 also has a portion, i.e., the horizontal portion 471, that passes the circumference of the opening portion, i.e., the window portion 430*b*, along the support wall 430 independently from the portion, i.e., the horizontal guide portion 473, for guiding the cable harness W.

According to this configuration, even if a part of the user body in a charged state comes close to the opening portion of the support wall 430 and electrostatic discharge enters the casing 201, for example, the current can be released to ground potential by the first guide wire 460 and the second guide wire 470. Therefore, the sheet presence sensor 442, the sheet leaning sensor 450, the control unit 250, and other electronic components can be protected from electrostatic discharge. Further, by adopting an elastic shape as the first guide wire 460 and the second guide wire 470, a conduction path to the ground potential can be ensured more reliably.

Furthermore, the first guide wire 460 and the second guide wire 470 serving as guide members according to the present embodiment are wire-forming members that are manufactured by bending metal wires from various directions by a wire-forming machine and the like, such that there is no need for a resin mold. Therefore, initial costs can be suppressed compared to a case where resin guide members are used.

Further, if fine-tuning of the wire length of the cable harness W or the wiring path is necessary, in a case where resin guide members are used, the molds must be cut or welded to realize adjustment, such that the costs for modification tends to be increased. In comparison, the guide member according to the present embodiment which is a wire-forming member formed of metal wire can cope with such fine-tuning with a relatively low cost by changing and adjusting programs of the wire forming machine.

According further to the guide members formed of resin, flashes and steps that may be generated at cavities and cores of a mold must be managed strictly to fall within a predetermined reference, such as 0.1 mm or less, so as not to damage the insulator of the cable harness by the guide member, and a periodical mold maintenance is required. Further, according to guide members formed of resin, the mold must be rounded to eliminate edges therefrom, but there are areas such as the joint between slides where rounding cannot be performed. There are limitations related to manufacture and design since it is necessary to consider a design in which such areas are not positioned along the wiring path of the cable harness.

In contrast, the guide member according to the present embodiment which is a wire-forming member formed of a metal wire does not require any management and maintenance of joints as in the case of molds, and edges are normally not generated during manufacture other than the cut surfaces at both ends of the metal wire. Therefore, the risk of damaging the cable harness can be suppressed. Specifically, the risk of damaging the cable harness can be suppressed even further by using a wire material having a round cross-sectional shape.

Modified Example

The helical portions 465 and 475 described above have cylindrical shapes, but the helical shapes thereof can also be formed by repeatedly bending the wire material to form a polygonal shape when viewed in the axial direction. For example, the helical portions 465 and 475 can be formed in a square column shape in which the wire material is bent to form a square shape when viewed in the axial direction, that is, the direction in which the cable harness W is wired.

Further according to the present embodiment, the first branch line W1 guided by the first guide wire 460 is extended approximately linearly in the Z axis direction, and the trunk line W0 guided by the second guide wire 470 is extended approximately linearly in the X axis direction. The present technique is not limited to this example, and the guide member can guide the electric cable along a bent or curved wiring path. In that case, the helical portions 465 and 475 are arbitrarily arranged at and oriented along the wiring path.

Second Embodiment

A guide member according to a second embodiment will be described. The guide member according to the present embodiment has a shape that differs from the guide member according to the first embodiment. In the following description, the elements denoted with the same reference numbers as the first embodiment are assumed as having an equivalent configuration and effect as those described in the first embodiment, and only the parts that differ from the first embodiment will mainly be described.

Figure 6:
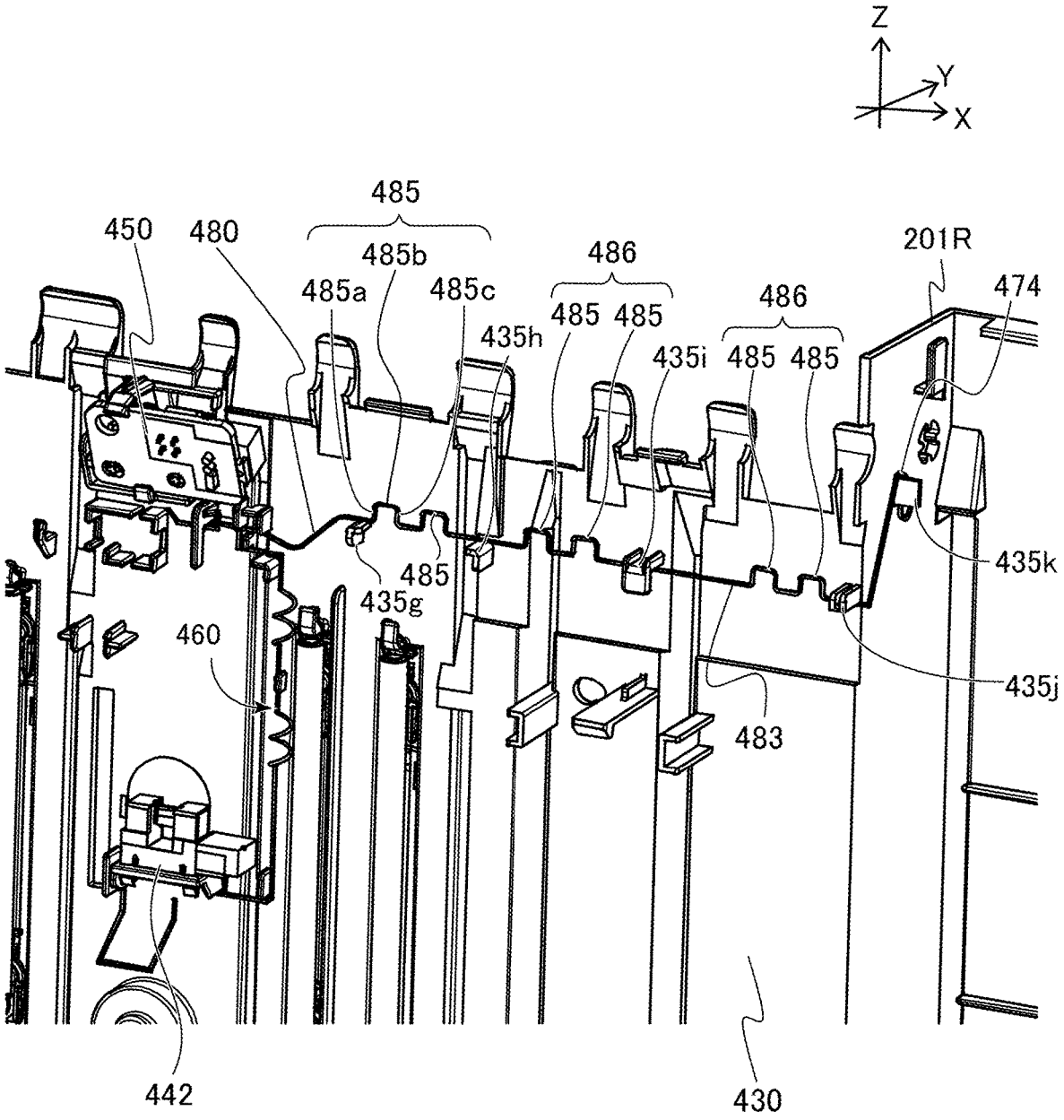
FIG. 6 is a perspective view illustrating a guide member according to a second embodiment.
Figure 7:
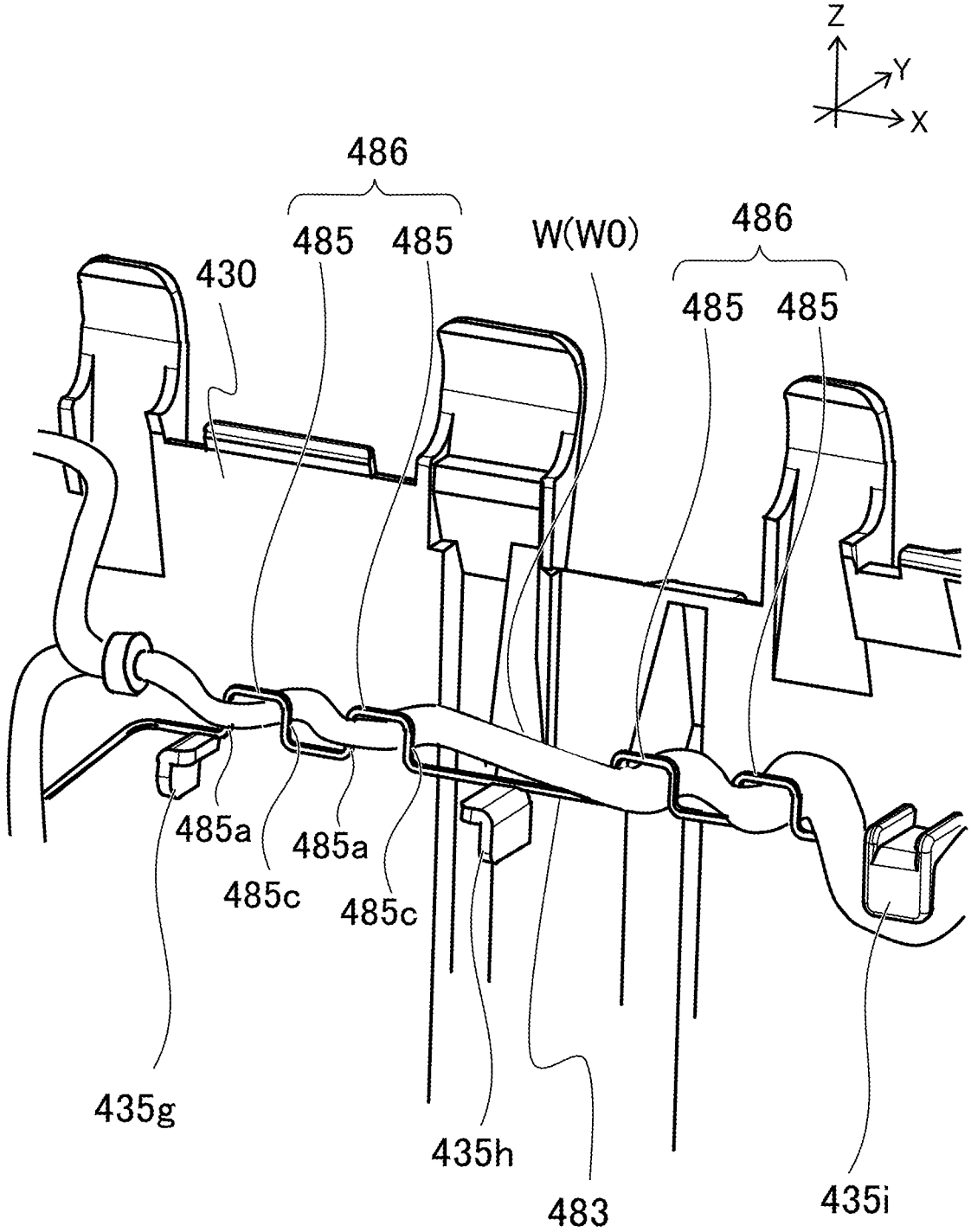
FIG. 7 is a perspective view illustrating a part of a wiring configuration of the second embodiment.

FIG. 6 is a perspective view illustrating a wiring configuration of the postprocessing apparatus 200 equipped with a second guide wire 480 according to the present embodiment viewed from a rear side of the support wall 430, with the cable harness W not attached. FIG. 7 is a perspective view illustrating a state in which the second guide wire 480 with the cable harness W attached thereto is mounted on the support wall 430.

As illustrated in FIG. 6, the second guide wire 480 according to the present embodiment has a wave shape in which projections and recesses (or ridges and valleys) are repeatedly formed in a predetermined direction intersecting with the direction, i.e., intersecting direction, especially the Z direction, along the main wiring direction, i.e., X axis direction, of the cable harness W, i.e., trunk line W0. More specifically, the second guide wire 480 according to the present embodiment includes connecting portions 486 composed of crank shapes, i.e., rectangular waves, formed by right-angled bends.

Each connecting portion 486 includes at least two cranked portions 485 that are arranged continuously in the wiring direction. Each cranked portion 485 that corresponds to one rectangular wave includes a rising portion 485*a* that rises upward in a right-angled bend from an extended portion that extends in an extending direction, i.e., X axis direction, of a horizontal guide portion 483, and a parallel portion 485*b* that extends in parallel with the extending direction from the second right-angled bend. Further, each cranked portion 485 includes a falling portion 485*c* that returns downward at a third right-angled bend, and returns to the extended portion of the horizontal guide portion 483 at the fourth right-angled bend. Such cranked portion 485 is provided at least at two areas in the horizontal guide portion 483.

Then, as illustrated in FIG. 7, the cable harness W and the cranked portions 485 are intertwined such that the cable harness W, i.e., trunk line W0, repeatedly passes a front side of the rising portion 485*a* from one side toward the other side in the wiring direction, i.e., X axis direction, then returns by passing the rear side of the falling portion 485*c*. That is, when viewed in the direction, i.e., Y axis direction, intersecting both the wiring direction of the cable harness W, i.e., X axis direction, and the predetermined direction, i.e., Z axis direction, the cable harness W is in a state alternately passing the front side and the depth side of the second guide wire 480 along the wiring direction.

If the cable harness W is considered as the subject, the connecting portions 486 of the second guide wire 470 are wound around the cable harness W along the wiring direction. When viewed from any direction of 360° within a plane orthogonal to the wiring direction, i.e., X axis direction, there is at least one area where the second guide wire 470 intersects the cable harness W on the front side of the cable harness W. The relationship between the second guide wire 480 and the cable harness W according to the present embodiment can be described as one aspect in which one of the two thread members is twisted around (i.e., turned around or rolled around) the other. If the second guide wire 470 is considered as the subject, the cable harness W is wound around the second guide wire 470 along the wiring direction, such that in the present embodiment, the cable harness W and the second guide wire 470 can also be described as being twisted around each other.

Figure 8A:
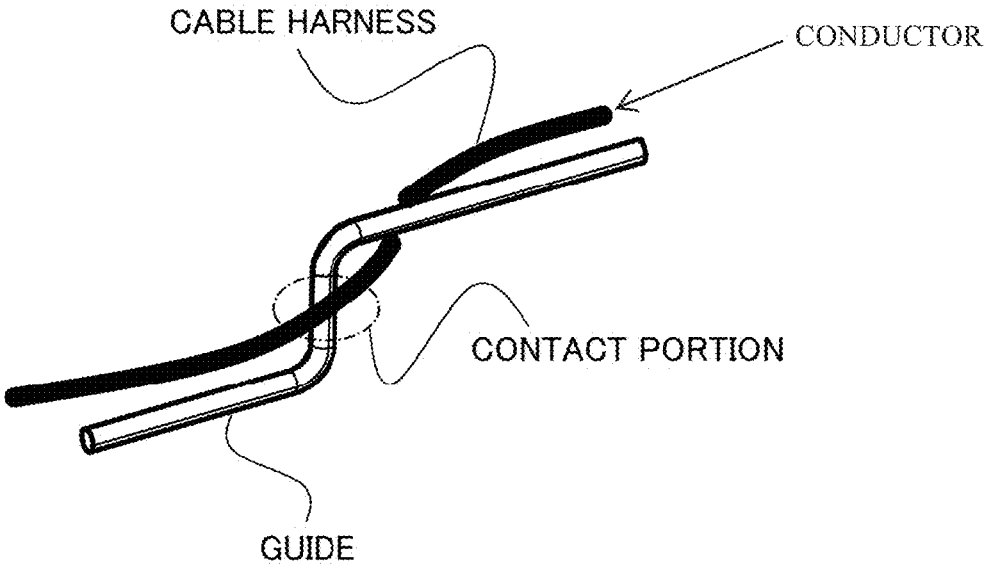
FIGS. 8A and 8B are each an explanatory view illustrating retention of a cable harness by the guide member according to the second embodiment.
Figure 8B:
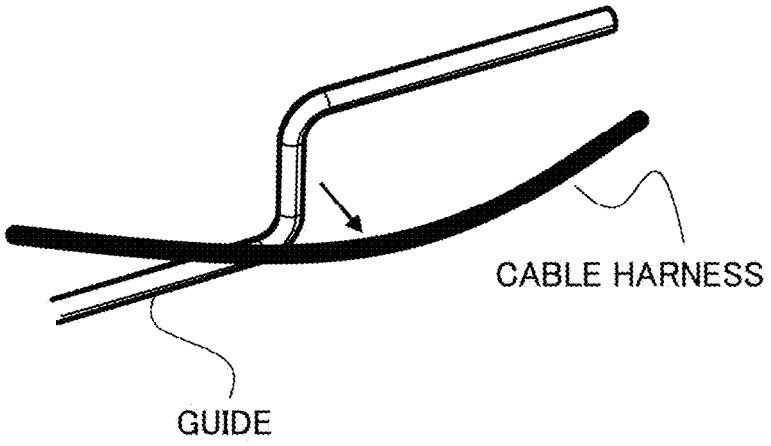
Figure 9A:
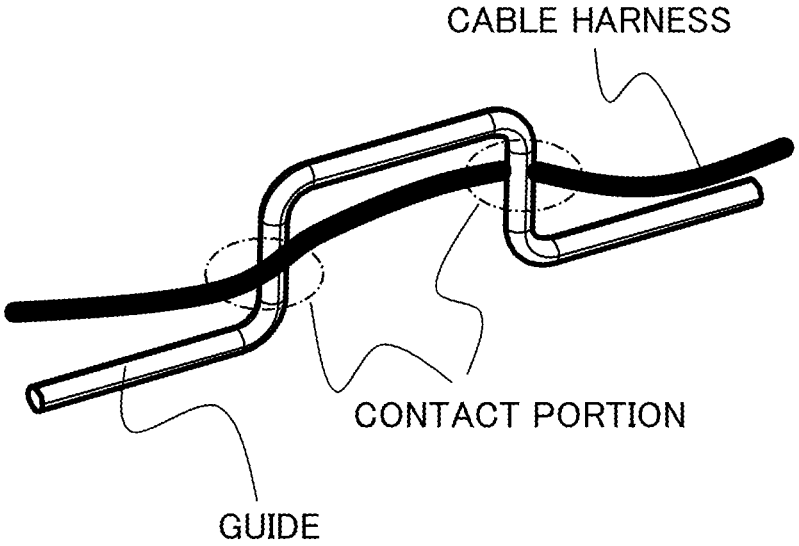
FIGS. 9A and 9B are each an explanatory view illustrating retention of the cable harness by the guide member according to the second embodiment.
Figure 9B:
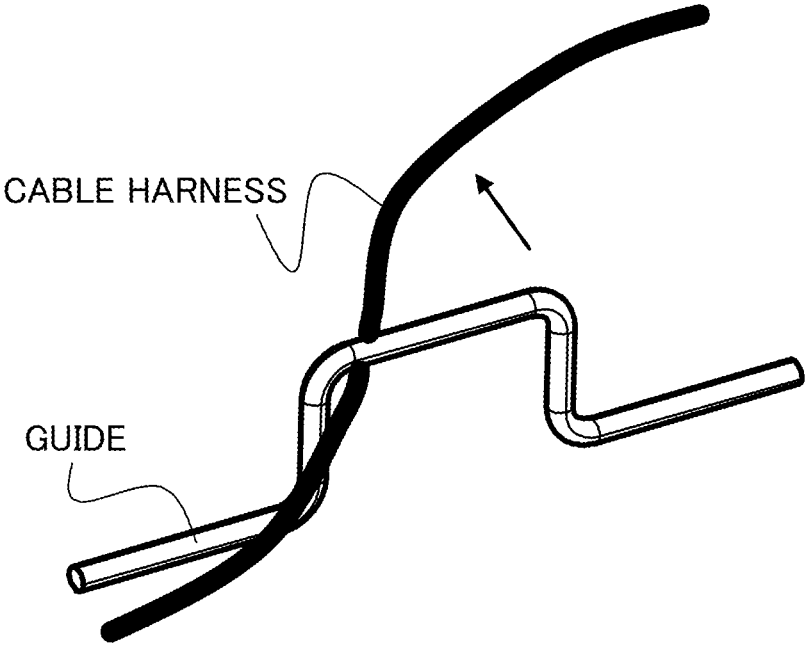
Figure 10:
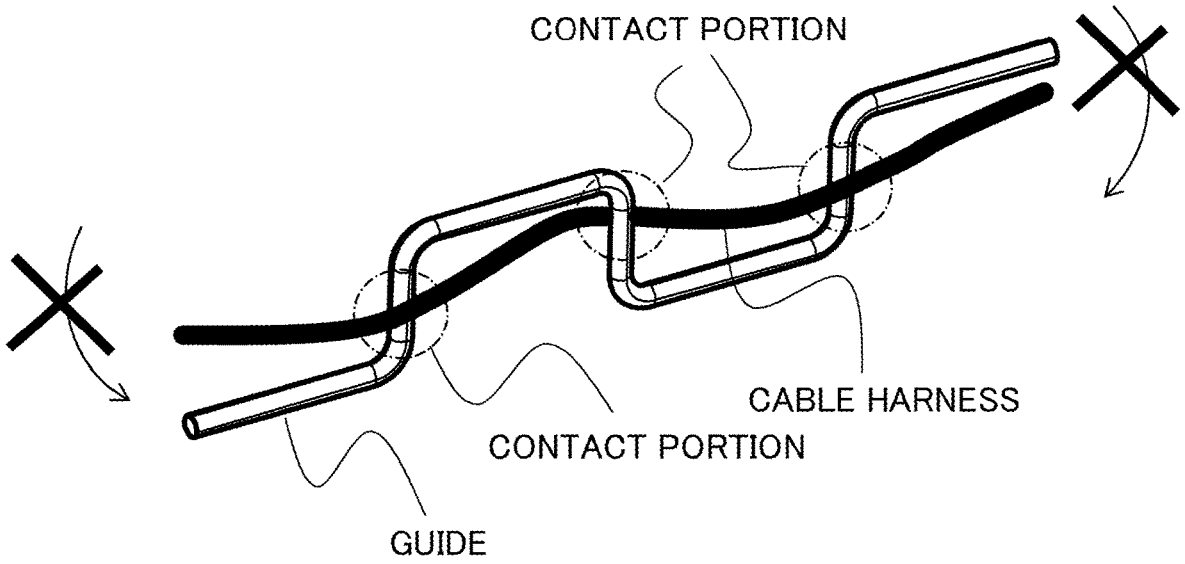
FIG. 10 is an explanatory view illustrating retention of the bundle wire by the guide member according to the second embodiment.

We will now describe the necessary number of contact areas, i.e., intersecting points, between the guide member retaining the cable harness and the cable harness. As illustrated in FIG. 8A, if there is only one contact, or intersection, the cable harness will easily separate from the guide member (FIG. 8B). If there are two contacts, i.e., intersections, as illustrated in FIG. 9A, the turning of the cable harness in a direction in which the right end thereof in the drawing heads toward the depth direction and the left end thereof heads toward the front direction is not restricted, such that the cable harness will separate relatively easily (FIG. 9B). If there are three contacts, or intersections, as illustrated in FIG. 10, the turning in both directions is restricted by the contact area positioned at the center, such that the cable harness will not easily separate from the guide member.

In the present embodiment, as illustrated in FIGS. 6 and 7, the connecting portions 486 are provided, each connecting portion 486 having at least two cranked portions 485 arranged continuously. In the illustrated example, there are three connecting portions 486 each composed of two cranked portions 485 provided on the horizontal guide portion 483. In the area between the connecting portions 486, the horizontal guide portion 483 serves as an extended portion that extends linearly and approximately in parallel with the wiring direction of the cable harness W, i.e., X axis direction. The number in which one connecting portion 486 intersects with the cable harness W in the Y axis direction is set to three or more, the number being the total number of the rising portions 485*a* and falling portions 485*c*. Meanwhile, the number in which one connecting portion 486 intersects with the cable harness W is set to 10 or less, preferably six or less, such that the operation of intertwining the cable harness W with the connecting portions 486 is not too complex. However, the entire horizontal guide portion 483 can be formed to have one continuous wave shape in which the cranked portions 485 are formed continuously.

As described, if the cable harness W is intertwined to the connecting portions 486 including at least two cranked portions 485, as illustrated in FIG. 7, the cable harness W intersects at three or more areas with the second guide wire 480 in one connecting portion 486. Thereby, the cable harness W will not be turned with respect to the second guide wire 480 when viewed in the Z axis direction. Further, even if the cable harness W attempts to move in an arbitrary direction intersecting with the extending direction of the cable harness W, i.e., X axis direction, the cable harness W will interfere with a part of the cranked portions 485. Therefore, the cable harness W will be retained without falling from the second guide wire 480.

Even according to the present embodiment, the cable harness W can be intertwined with the connecting portions 486 while having one of the end portions of the second guide wire 480 retained on the support wall 430 and winding the other end portion of the second guide wire 480 around the cable harness W. In other words, the widths and heights of the cranked portions 485 are set such that the cable harness W can be easily intertwined with the cranked portions 485 by winding the second guide wire 480 around the cable harness W.

The method for attaching the second guide wire 480 to the support wall 430 is basically the same as the first embodiment. The first guide wire 460 similar to that of the first embodiment can be used, or the first guide wire 460 having cranked shapes can be used instead of the helical portions 465.

As described, also according to the present embodiment, by having the electric cable retained by the guide member formed of a metal wire material and attaching the guide member to the casing, the space required for wiring the electric cable can be reduced while improving the workability of the wiring operation.

One of the advantages of the present embodiment is that the second guide wire 480 can be formed more easily. That is, the guide member according to the first embodiment has helical portions 465 and 475 having helical shapes formed continuously with the linear portion, such that there is a need to cautiously set the processing conditions of the wire-forming process. In contrast, the second guide wire 480 according to the present embodiment includes the cranked portions 485 composed of right-angle bends as the shapes for retaining the cable harness W, such that the bending process can be performed more easily.

According further to the present embodiment, the cable harness W is wired in a manner stitched between the cranked portions 485 of the second guide wire 480, such that when the cable harness W is pulled in the wiring direction, the frictional force received from the cranked portions 485 restricts the movement of the cable harness W. Therefore, even if external force is applied in the direction pulling the cable harness W after having the cable harness W retained in the second guide wire 480, the cable harness W will not be easily displaced with respect to the second guide wire 480.

Third Embodiment

A guide member according to a third embodiment will be described. The guide member according to the present embodiment is a modified example of the guide member according to the second embodiment. In the following description, the elements denoted with the same reference numbers as the first embodiment are assumed as having an equivalent configuration and effect as those described in the first embodiment, and only the parts that differ from the first embodiment will mainly be described.

Figure 11:
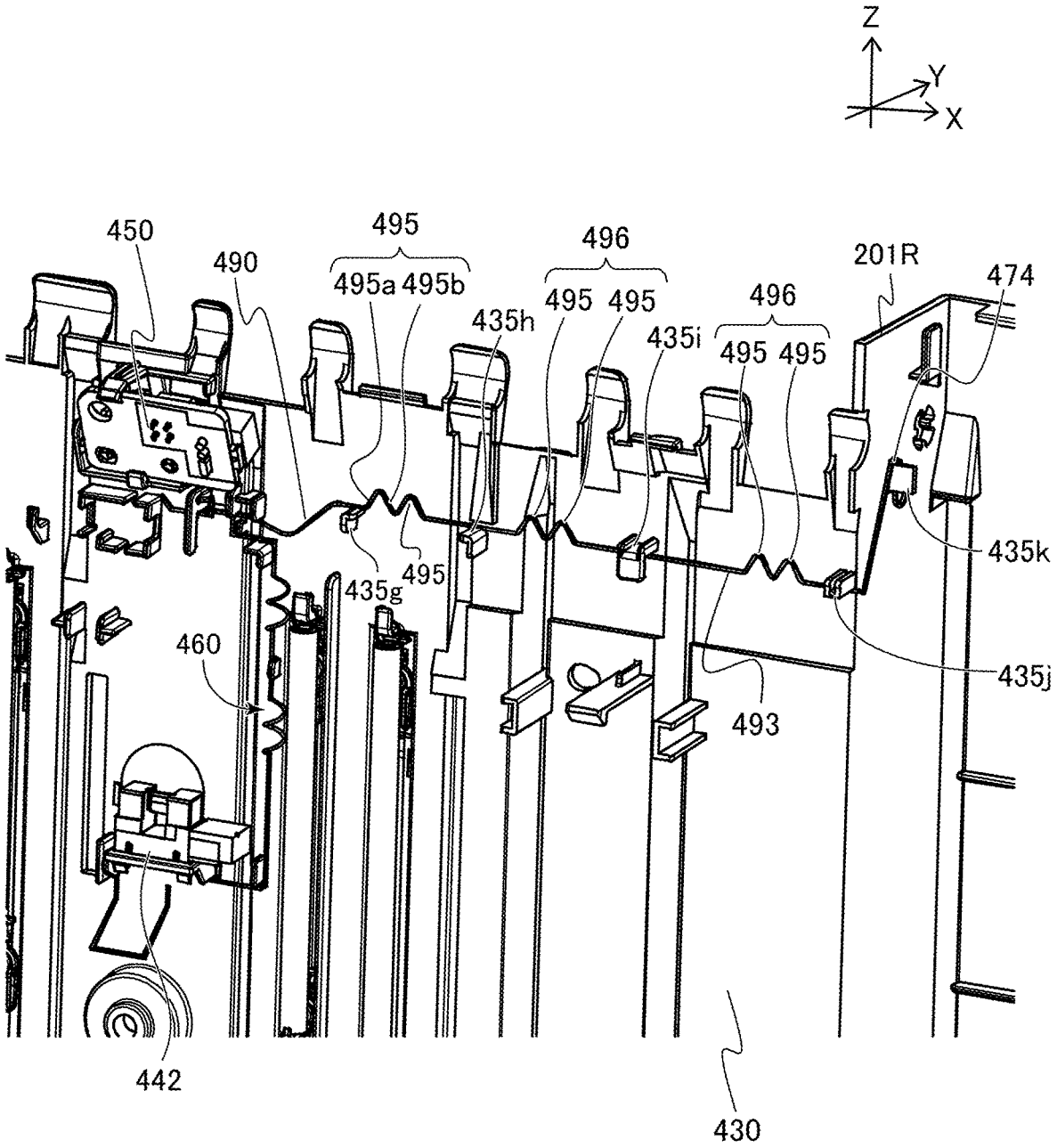
FIG. 11 is a perspective view illustrating a guide member according to a third embodiment.
Figure 12:
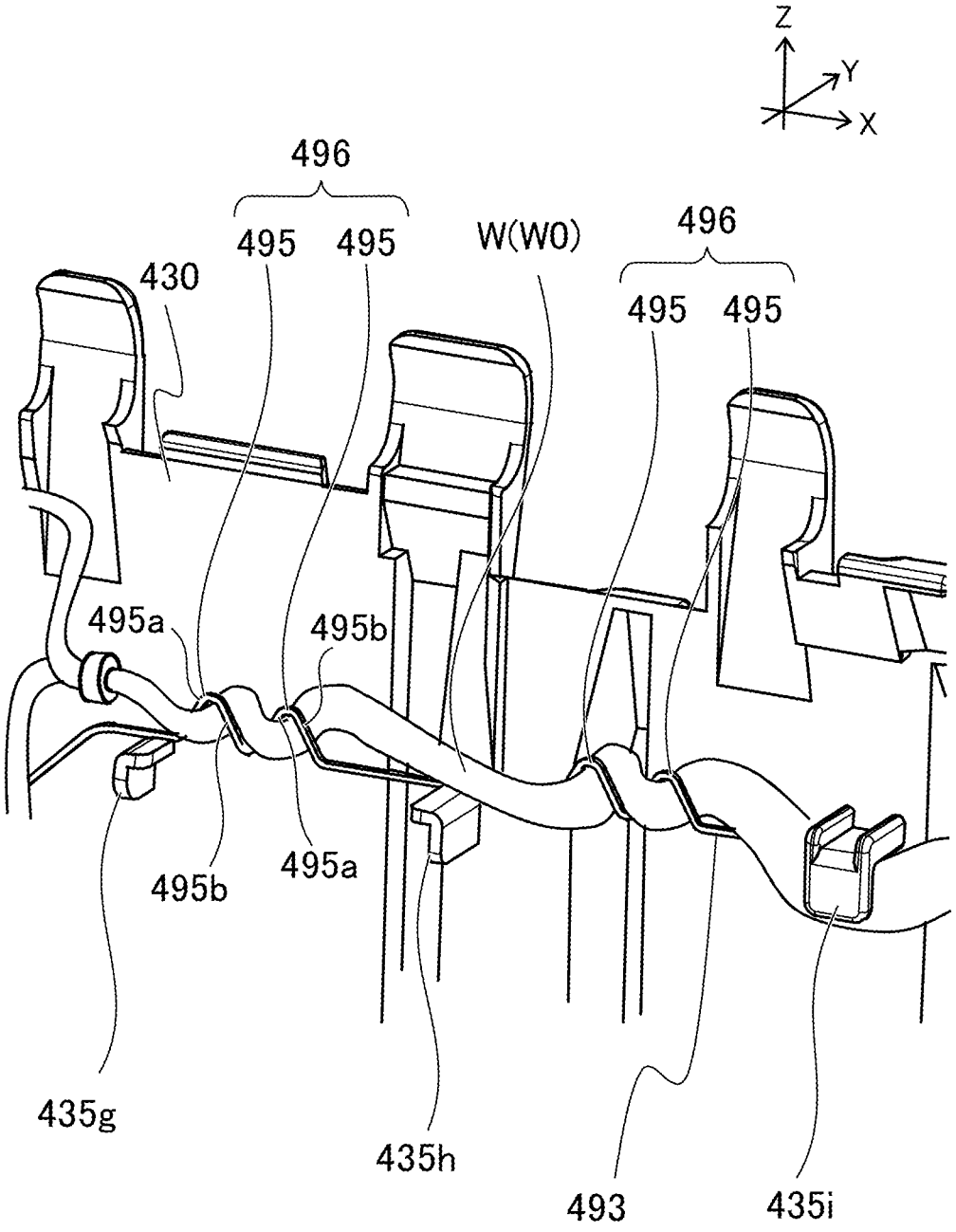
FIG. 12 is a perspective view illustrating a part of a wiring configuration according to the third embodiment.

FIG. 11 is a perspective view illustrating a wiring configuration of the postprocessing apparatus 200 equipped with a second guide wire 490 according to the present embodiment viewed from a rear side of the support wall 430, with the cable harness W not attached. FIG. 12 is a perspective view illustrating a state in which the second guide wire 490 with the cable harness W attached thereto is mounted on the support wall 430.

According to the second embodiment, the cable harness W is intertwined with the connecting portions 486 having a perpendicularly cranked shape, i.e., rectangular waves, of the second guide wire 480, whereas in the present embodiment, a second guide wire 490 having connecting portions 496 of triangular cranked shapes, i.e., triangular waves, is used. As illustrated in FIG. 11, the connecting portions 496 include at least two triangular cranked portions 495 that are formed continuously in the wiring direction of the cable harness W, i.e., the X axis direction.

Each triangular cranked portion 495 includes a rising portion 495*a* that rises upward by being bent in an obtuse angle from the extended portion that extends in the extending direction, i.e., X axis direction, of a horizontal guide portion 493, and a falling portion 495*b* that extends downward by being bent in an acute angle from the rising portion. The triangular cranked portion 495 returns to the extended portion at the second bent portion bent in the obtuse angle from the falling portion 495*b*. The angles of the obtuse angle and the acute angle are, for example, 120° and 60° in the inner side angles of the bent portion.

That is, the connecting portions 496 according to the present embodiment are formed in the shapes of triangular waves as another example of the wave shapes that are formed in the shapes of repeated projections and recesses in the predetermined direction, i.e., intersecting direction, especially the Z axis direction, intersecting with the wiring direction of the main wiring direction, i.e., X axis direction, of the cable harness W, i.e., the trunk line W0.

Then, as illustrated in FIG. 12, the cable harness W and the triangular cranked portions 495 are intertwined such that the cable harness W, i.e., the trunk line W0, repeatedly passes a front side of the rising portion 495*a* from one side toward the other side in the wiring direction, i.e., X axis direction, then returns by passing a rear side of the falling portion 495*b*. In other words, when viewed in the direction, i.e., Y axis direction, intersecting both the wiring direction of the cable harness W, i.e., X axis direction, and the predetermined direction, i.e., Z axis direction, the cable harness W is passed alternately through the front side and the depth side of the second guide wire 490 along the wiring direction. The relationship between the second guide wire 490 and the cable harness W according to the present embodiment can also be referred to as one aspect in which one of the two thread members is twisted around the other.

As described, if the cable harness W is intertwined with the connecting portions 496 including at least two triangular cranked portions 495, as illustrated in FIG. 12, the cable harness W is intersected at least at three areas of the second guide wire 490 in one connecting portion 496. According to this configuration, the cable harness W will not be turned with respect to the second guide wire 490 when viewed in the Z axis direction. Further, even if the cable harness W attempts to move in an arbitrary direction intersecting the extending direction of the cable harness W, i.e., X axis direction, the cable harness W will interfere with a part of the triangular cranked portions 495. Therefore, the cable harness W will be retained without falling from the second guide wire 490.

Also according to the present embodiment, the cable harness W can be intertwined with the connecting portions 496 while having one of the end portions of the second guide wire 490 retained on the support wall 430 and the other end portion of the second guide wire 490 wound around the cable harness W. In other words, the widths and heights of the triangular cranked portions 495 are set such that the cable harness W can be easily intertwined with the triangular cranked portions 495 by winding the second guide wire 490 around the cable harness W.

The method for attaching the second guide wire 490 to the support wall 430 is basically the same as the first embodiment. The first guide wire 460 similar to that of the first embodiment can be used, or the first guide wire 460 having triangular cranked shapes can be used instead of the helical portions 465.

As described, also according to the present embodiment, by having the electric cable retained by the guide member formed of a metal wire material and attaching the guide member to the casing, the space required for wiring the electric cable can be reduced while improving the workability of the wiring operation.

Modified Example

The connecting portions 486 and 496 of the second guide wire 490 according to the second and third embodiments are merely examples of the wave shapes in which projections and recesses in the predetermined direction are continuously repeated along the wiring direction, and for example, wave-shaped connecting portions in which semicircles facing up and semicircles facing down are continuously formed can be used.

Fourth Embodiment

A guide member according to a fourth embodiment will be described. In the following description, the elements denoted with the same reference numbers as the first embodiment are assumed as having an equivalent configuration and effect as those described in the first embodiment, and only the parts that differ from the first embodiment will mainly be described.

Figure 13:
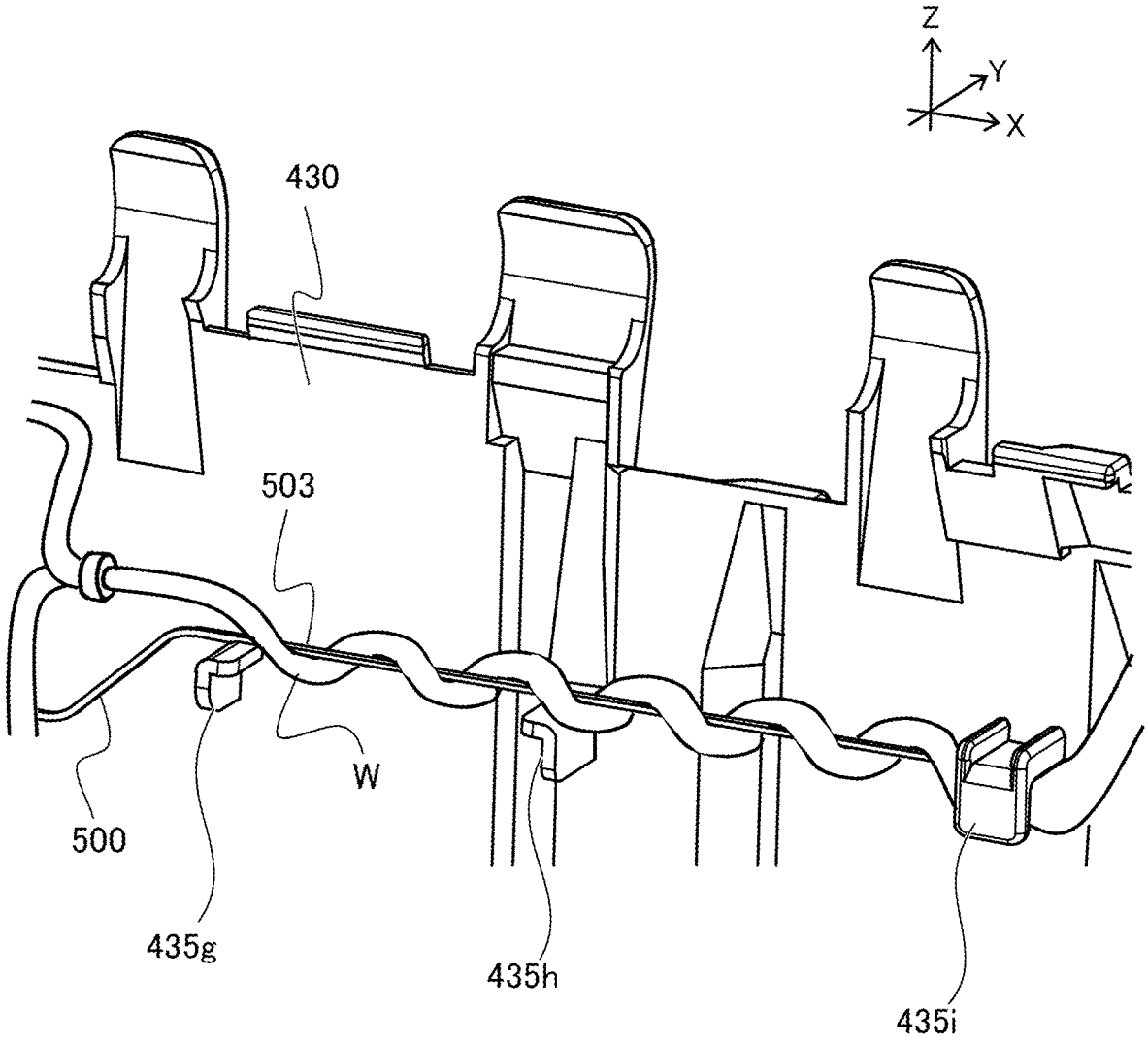
FIG. 13 is a perspective view illustrating a part of a wiring configuration according to a fourth embodiment.

FIG. 13 is a perspective view illustrating a state in which a second guide wire 500 according to the present embodiment with the cable harness W attached thereto is mounted on the support wall 430. A horizontal guide portion 503 of the second guide wire 500 according to the present embodiment is formed linearly in a manner approximately horizontally with the X axis direction which is the main wiring direction of the cable harness W, i.e., the trunk line W0.

The cable harness W is twisted helically around the horizontal guide portion 503. Therefore, when viewed from any direction of 360° within a plane orthogonal to the wiring direction, i.e., X axis direction, there is at least one area where the second guide wire 500 intersects with the cable harness W on the front side of the cable harness W. In other words, the relationship between the second guide wire 500 and the cable harness W according to the present embodiment can be described as one example of an aspect in which one of the two thread members is twisted around the other.

The number and intervals of the twisting of the cable harness W around the horizontal guide portion 503 is determined by taking into consideration the number of cables in the cable harness W and the length of the horizontal guide portion 503, for example. If the cable harness W is loosened or separated, it is desirable to twist the cables of the cable harness W in advance.

Other Examples

The above embodiments have illustrated a wiring configuration of the cable harness W connecting the control unit 250 to the sheet presence sensor 442 and the sheet leaning sensor 450 in the postprocessing apparatus 200. The techniques described in the present disclosure is not limited to this example, and can be applied to wirings in general adopted in sheet conveyance apparatuses. The sheet conveyance apparatuses refer to apparatus for conveying sheet materials in general, and for example, they can be an image forming apparatus body for forming images on sheets while conveying sheets, or an image reading apparatus for reading image information while conveying sheets.

For example, various sensors are arranged in the sheet conveyance apparatus with the aim to control sheet conveyance, detect conveyance abnormalities, and detect stacked amount of sheets, for example. Examples include the sheet sensor 209 (FIG. 1) for detecting sheets along the conveyance path of the postprocessing apparatus 200, and a full-load detection sensor for detecting that the stacked amount of sheets on the sheet discharge tray has reached an upper limit. Further, various actuators are disposed in the sheet conveyance apparatus, such as a motor for driving conveyance members such as roller pairs and belts for conveying sheets, a motor for lifting and lowering stacking portions, and a solenoid for opening and closing a nip portion of the roller pair. The technique taught in the present disclosure is applicable to the wiring configuration of electric cables connecting such sensors or actuators with the control unit of the sheet conveyance apparatus.

The technique according to the present disclosure is applicable not only to electric cables connecting sensors or actuators with control units, but also to wiring configurations of electric cables connecting power supply boards with devices receiving power supply from the power supply boards or to electric cables connecting control units with relay boards.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-183831, filed on Nov. 11, 2021, which is hereby incorporated by reference herein in its entirety.

What is claimed is:

1. A sheet conveyance apparatus comprising:

a casing;

an electric cable including a conductor and an insulator configured to cover the conductor;

a guide member attached to the casing and configured to guide the electric cable;

a sensor configured to generate a detection signal corresponding to a presence or an absence of a sheet; and a control unit configured to control the sheet conveyance apparatus based on the detection signal, the electric cable being configured to electrically connect the sensor and the control unit, wherein the guide member includes a wire-forming member formed of a metal wire, and wherein the electric cable is wired along the guide member with at least one of the electric cable and the guide member twisted around the other of the electric cable and the guide member.

2. The sheet conveyance apparatus according to claim 1, wherein the casing includes a conductive member that is electrically grounded, and wherein the guide member is arranged in contact with the conductive member.

3. The sheet conveyance apparatus according to claim 2, wherein the guide member includes an elastic shape configured to generate an elastic force so as to cause a part of the guide member to be in pressure contact with the conductive member.

4. The sheet conveyance apparatus according to claim 2, wherein the guide member is a first guide member configured to guide a part of the electric cable, wherein the sheet conveyance apparatus further includes a second guide member configured to guide another portion of the electric cable, wherein the first guide member is in contact with the conductive member, and wherein the second guide member is in contact with the first guide member and electrically grounded via the first guide member.

5. The sheet conveyance apparatus according to claim 4, wherein at least one of the first guide member and the second guide member includes an elastic shape configured to generate an elastic force so as to cause a part of the first guide member to be in pressure contact with a part of the second guide member.

6. The sheet conveyance apparatus according to claim 1, wherein the sensor is a first sensor, wherein the sheet conveyance apparatus further includes a second sensor configured to generate a detection signal corresponding to a presence or absence of a sheet, wherein the electric cable includes a first branch line connected to the first sensor, a second branch line connected to the second sensor, and a trunk line in which the first branch line and the second branch line are merged, wherein the guide member is a first guide member configured to guide one of the first branch line, the second branch line, and the trunk line, and wherein the sheet conveyance apparatus further includes a second guide member configured to guide another one of the first branch line, the second branch line, and the trunk line.

7. The sheet conveyance apparatus according to claim 6, wherein the casing includes a wall member to which the first sensor and the second sensor are attached, wherein the first branch line is wired in a first direction along the wall member, wherein the trunk line is wired in a second direction intersecting with the first direction along the wall member, wherein the first guide member is configured to extend in the first direction and guide the first branch line, and wherein the second guide member is configured to extend in the second direction and guide the trunk line.

8. The sheet conveyance apparatus according to claim 7, further comprising:

a stacking portion configured to protrude to an outside of the casing with respect to the wall member and on which a sheet discharged from the casing is stacked, wherein the first sensor is configured to generate a detection signal corresponding to a presence or absence of a sheet stacked on the stacking portion, and wherein the second sensor is configured to generate a detection signal corresponding to a presence or absence of a sheet leaning against the wall member.

9. The sheet conveyance apparatus according to claim 8, further comprising:

a first moving member arranged on the stacking portion and configured to swing when pressed by a sheet stacked on the stacking portion; and a second moving member arranged on the casing and configured to swing when pressed by the first moving member, wherein the first sensor is a photosensor configured to be shielded of light by the second moving member, and wherein the second sensor is a photosensor configured to emit light from the wall member to a space above the stacking portion and detect reflected light from the sheet.

10. The sheet conveyance apparatus according to claim 8, wherein the stacking portion is configured to be lifted and lowered with respect to the casing, wherein the sheet conveyance apparatus further includes a sliding member supported slidably in an up and down direction on the wall member and configured to move following a lifting and lowering of the stacking portion, and a coil spring arranged with an axial direction thereof along the up and down direction and configured to urge the sliding member upward, and wherein the first branch line is wired along a space formed between the coil spring and the first sensor.

11. The sheet conveyance apparatus according to claim 1, wherein the casing includes a first retaining portion configured to retain one of end portions of the guide member, and a second retaining portion configured to retain the other of the end portions of the guide member, and wherein the guide member has a shape by which at least one of the electric cable and the guide member can be twisted around the other in a state where the one of the end portions is retained by the first retaining portion and the other of the end portions is not retained by the second retaining portion.

12. The sheet conveyance apparatus according to claim 1, wherein the guide member includes a helical shape of which an axial direction is a wiring direction of the electric cable and by which guide member is twisted around the electric cable.

13. The sheet conveyance apparatus according to claim 12, wherein the guide member includes a plurality of helical portions, each having the helical shape with one or more number of turns and arranged separated from one another in the wiring direction, and an extended portion extending in the wiring direction and configured to connect the plurality of helical portions.

14. The sheet conveyance apparatus according to claim 1, wherein the guide member includes a wave shape in which projections and recesses in an intersecting direction intersecting a wiring direction of the electric cable are repeatedly arranged along the wiring direction, and wherein, when viewed in a direction intersecting both the wiring direction and the intersecting direction, the wave shape of the guide member and the electric cable are twisted around each other such that the electric cable alternately passes a front side and a depth side of the guide member along the wiring direction.

15. The sheet conveyance apparatus according to claim 1, wherein the guide member includes a linear portion extending linearly along a wiring direction of the electric cable, and wherein the electric cable is twisted helically around the linear portion.

16. The sheet conveyance apparatus according to claim 1, wherein the casing includes projection configured to retain the guide member, and wherein the guide member includes a shape bent along the projection.

17. The sheet conveyance apparatus according to claim 16, wherein the projection is formed integrally of a resin material together with a wall member configured to constitute at least a part of a side face of the casing.

18. A sheet processing apparatus comprising:

a sheet conveyance apparatus; and a processing unit configured to process a sheet conveyed by the sheet conveyance apparatus, wherein the sheet conveyance apparatus includes:

a casing;

an electric cable including a conductor and an insulator configured to cover the conductor; and a guide member attached to the casing and configured to guide the electric cable, wherein the guide member includes a wire-forming member formed of a metal wire, and wherein the electric cable is wired along the guide member with at least one of the electric cable and the guide member twisted around the other of the electric cable and the guide member.

19. The sheet conveyance apparatus according to claim 18, wherein the casing includes a wall member with an opening portion, wherein the sheet conveyance apparatus further includes a sensor configured to detect a target object on an outside of the casing through the opening portion, and wherein the guide member includes a portion that passes a circumference of the opening portion along the wall member.

20. The sheet conveyance apparatus according to claim 19, wherein the sensor includes a movable member configured to protrude to the outside of the casing through the opening portion and move when the movable member comes in contact with the target object, and a detecting portion configured to generate a signal corresponding to a position of the movable member.

21. The sheet conveyance apparatus according to claim 19, wherein the sensor includes a light emitting portion configured to emit light to the outside of the casing through the opening portion, and a detecting portion configured to generate a signal corresponding to the light reflected on the target object and entered through the opening portion.

22. An image forming apparatus comprising:

a sheet conveyance apparatus; and an image forming unit configured to form an image on a sheet conveyed by the sheet conveyance apparatus, wherein the sheet conveyance apparatus includes:

a casing;

an electric cable including a conductor and an insulator configured to cover the conductor; and a guide member attached to the casing and configured to guide the electric cable, wherein the guide member includes a wire-forming member formed of a metal wire, and wherein the electric cable is wired along the guide member with at least one of the electric cable and the guide member twisted around the other of the electric cable and the guide member.

* * * * *